United States Patent [19]

Turpin et al.

[11] Patent Number: 4,904,836

[45] Date of Patent: Feb. 27, 1990

[54] MICROWAVE HEATER AND METHOD OF MANUFACTURE

[75] Inventors: Charles H. Turpin, Minneapolis; Michael R. Perry, Plymouth, both of Minn.

[73] Assignee: The Pillsbury Co., Minneapolis, Minn.

[21] Appl. No.: 198,812

[22] Filed: May 23, 1988

[51] Int. Cl.[4] ..... H05B 6/80

[52] U.S. Cl. ..... 219/10.55 E; 219/10.55 F; 426/107; 426/234; 426/243; 99/DIG. 14; 126/390

[58] Field of Search ..... 219/10.55 E, 10.55 F, 219/10.55 R, 10.55 M; 426/107, 109, 111–114, 234, 241, 242, 243; 99/DIG. 14, 451; 126/390

[56] References Cited

U.S. PATENT DOCUMENTS

| | | | |
|---|---|---|---|
| 3,519,517 | 7/1970 | Dench | 156/380 |
| 3,731,037 | 5/1973 | Levinson | 219/10.55 |
| 3,783,220 | 1/1974 | Tanizaki | 219/10.55 |
| 3,848,038 | 11/1974 | Dench | 264/51 |
| 3,922,452 | 11/1975 | Forker et al. | 428/35 |
| 3,985,991 | 10/1976 | Levinson | 219/10.55 E |
| 4,015,085 | 3/1977 | Woods | 219/10.55 E |
| 4,027,384 | 6/1977 | Connolly et al. | 29/592 |
| 4,082,413 | 4/1978 | Austin et al. | 350/1.1 |
| 4,140,889 | 2/1979 | Mason et al. | 219/10.55 E |
| 4,190,757 | 2/1980 | Turpin et al. | 219/10.55 E |
| 4,210,674 | 7/1980 | Mitchell | 426/107 |
| 4,230,924 | 10/1980 | Brastad et al. | 219/10.55 E |
| 4,267,420 | 5/1981 | Brastad | 219/10.55 E |
| 4,283,427 | 8/1981 | Winters et al. | 426/107 |
| 4,306,133 | 12/1981 | Levinson | 219/10.55 E |
| 4,345,133 | 8/1982 | Cherney et al. | 219/10.55 E |
| 4,362,917 | 12/1982 | Freedman et al. | 219/10.55 E |
| 4,398,077 | 8/1983 | Freedman et al. | 219/10.55 E |
| 4,434,197 | 2/1984 | Petriello | 427/407.1 |
| 4,450,334 | 5/1984 | Bowen et al. | 219/10.55 E |
| 4,454,403 | 6/1984 | Teich et al. | 219/10.55 E |
| 4,486,640 | 12/1984 | Bowen et al. | 219/10.55 E |
| 4,496,815 | 1/1985 | Jorgensen | 219/10.55 E |
| 4,518,651 | 5/1985 | Wolfe | 428/308.8 |
| 4,542,271 | 9/1985 | Tanonis et al. | 219/10.55 E |
| 4,640,838 | 2/1987 | Isakson et al. | 426/107 |
| 4,641,005 | 2/1987 | Seiferth | 219/10.55 E |
| 4,642,434 | 2/1987 | Cox et al. | 219/10.55 E |
| 4,653,641 | 3/1987 | Gladon et al. | 206/459 |
| 4,656,325 | 4/1987 | Keefer | 219/10.55 E |
| 4,663,506 | 5/1987 | Bowen et al. | 219/10.55 E |
| 4,676,857 | 6/1987 | Scharr et al. | 156/233 |
| 4,701,585 | 10/1987 | Stewart | 219/10.55 E |
| 4,703,148 | 10/1987 | Mikulski et al. | 219/10.55 E |
| 4,705,707 | 11/1987 | Winter | 428/35 |
| 4,816,634 | 3/1989 | Lentz et al. | 219/10.55 E |

FOREIGN PATENT DOCUMENTS

| | | |
|---|---|---|
| 28375 | 8/1987 | Australia . |
| 240071 | 10/1987 | European Pat. Off. . |
| 0242952 | 10/1987 | European Pat. Off. . |
| 0247922 | 12/1987 | European Pat. Off. . |
| 3703163 | 8/1987 | Fed. Rep. of Germany . |
| 62-252832 | 11/1987 | Japan . |
| 2188641 | 10/1987 | United Kingdom . |
| 2191148 | 12/1987 | United Kingdom . |

OTHER PUBLICATIONS

"New Product Concepts in Microwaveable Food Packaging"–Huang–Date (unknown).

"On The Thermal Modeling of Foods in Electromagnetic Fields"–Ofoli–Date (unknown).

"Mathematical Modeling of Microwave Heating by The Method of Dimensional Analysis"–Ofoli–Date (unknown).

*Primary Examiner*—Philip H. Leung

*Attorney, Agent, or Firm*—Robert J. Lewis; William J. Connors

[57] ABSTRACT

A microwave food package with a heater and method of manufacture are provided. The heater includes a substrate coated with a microwave lossy material having a thickness in the range of between about 0.001 cm and about 0.025 cm and an inverse penetration depth greater than about 0.01 $cm^{-1}$. The layer of lossy material is preferably in liquid form when applied to the substrate and is non-liquid when used. The lossy material can have electric field loss properties alone or magnetic loss properties and combination thereof.

42 Claims, 20 Drawing Sheets

Fig.-25
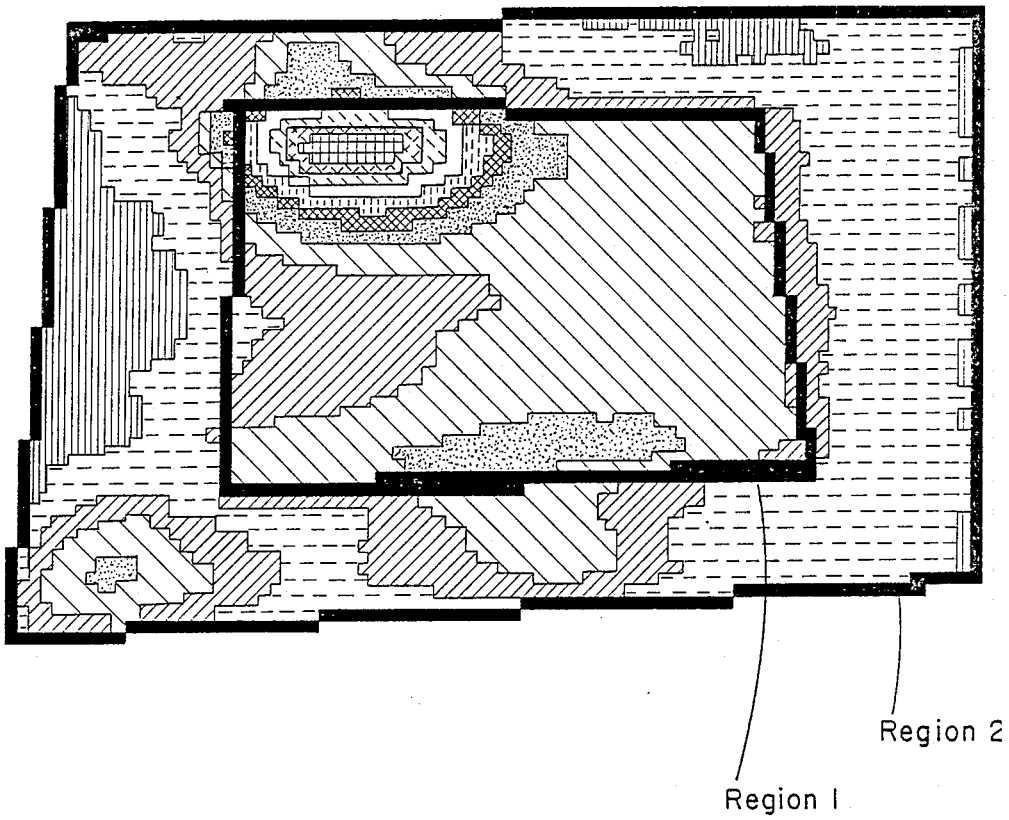
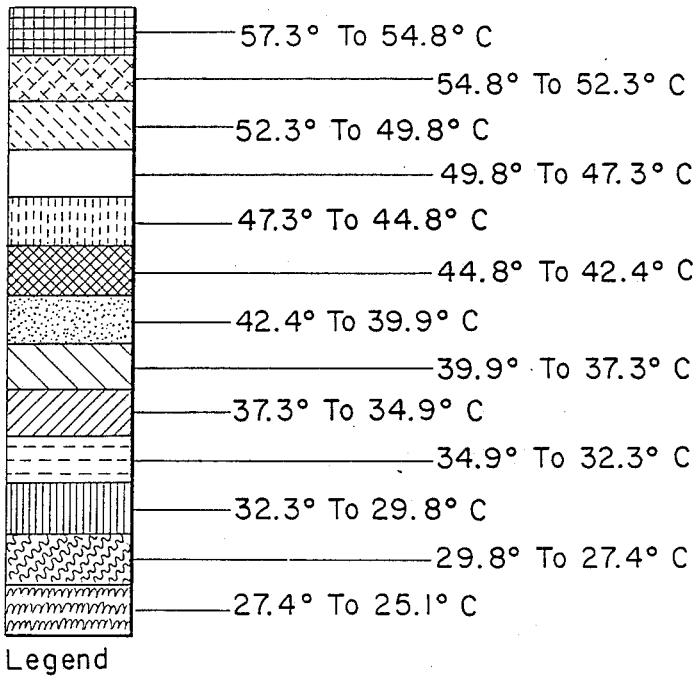

FIGURE ~~35~~ 36
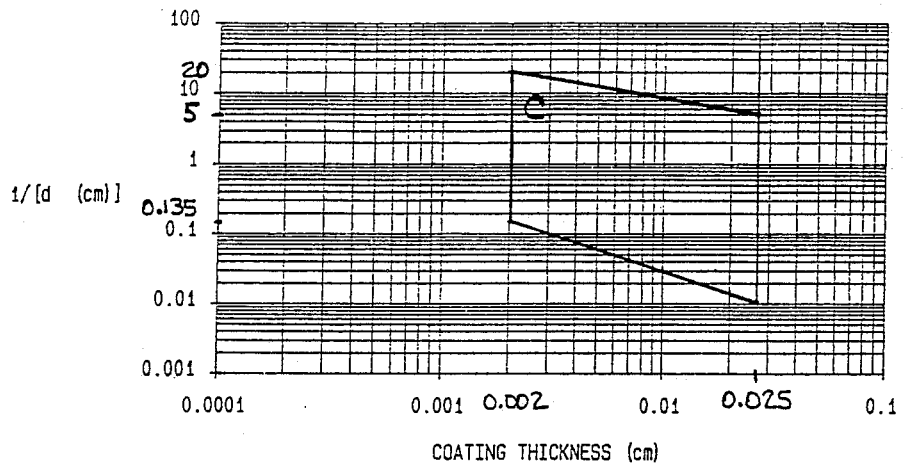

37

MICROWAVE HEATER AND METHOD OF MANUFACTURE

BACKGROUND OF THE INVENTION

In the cooking or heating of foods in a microwave oven, it is sometimes desirable to provide a supplemental heat source. Providing a hot surface adjacent to the food surface performs a number of useful purposes, among them being enhancing the crisping of a microwave heated food surface which would otherwise be soft or soggy, browning a food surface to provide desirable color and accelerating the heating of low loss foods such as oil in microwave popcorn, resulting in better product performance.

Heaters able to achieve these effects can take various forms. In general these heaters (susceptors) convert microwave energy into thermal energy.

Such susceptors may be described as devices positioned in close proximity (heat transfer relationship) to a food surface and are capable of preferentially absorbing microwave energy such that the food surface heats faster or hotter or both than it would when exposed to microwave energy without a susceptor present.

Such heaters can be in the form of a disposable packaging component or a utensil. Incorporating a susceptor into a disposable package provides a very desirable increase in user convenience and satisfaction.

Typical of disposable package heaters are the metallized polyester heaters as disclosed by Seiferth, U.S. Pat. No. 4,641,005 and Brastad, U.S. Pat. No. 4,267,420.

The heaters disclosed by Seiferth and Brastad are metallized polyester. The layer of metal must be thin in order to work. The thickness of the metal layer must be on the order of less than about $3\text{–}5\times10^{-6}$ cm (300 to 500 angstroms) or the metal will not heat enough to cook food. In practical terms, thick metal layers act as reflectors and prevent the transmission of microwave energy therethrough to a food product. That is, its absorption and transmission are, for practical purposes, zero.

European patent application Ser. No. 0,242,952 discloses a composite material for use as a microwave heater. The material comprises a dielectric substrate coated with a mixture of an electrically conductive metal or metal alloy in flake form in a thermoplastic dielectric matrix. The DC surface resistance of the resulting composite is greater than $1\times10^{6}$ ohms per square, thereby eliminating resistance characteristics as the heating mechanism. Further, the flakes used in the material are relatively thick and on their own would not be lossy at the thickness of 0.1 to 0.5 micrometers (microns). Further it is disclosed that the flakes are substantially insulated from each other, precluding electrical conductivity from one portion of the heater to the next. In addition, the flakes are required to have a high aspect ratio, that is, in the range of 10 to 300. The aspect ratio is defined as the ratio of the largest dimension of the face to the thickness of the flakes.

U.S. Pat. No. 4,518,651 (Wolfe) discloses a microwave heater which uses a lossy layer which is relatively thin. The heater is manufactured by coating a substrate with a liquid. The heating layer is pressure formed into the substrate to provide heating. After pressure forming the thickness of the layer is less than 10 micrometers. It can be seen from the disclosure at column 8 that an increase in thickness achieved by increasing the coating weight does not increase heating.

The metal flakes enrobed in a dielectric substance disclosed by Wolfe uses a complex system for production. Also, Wolfe's susceptor films are quite thin, being on the order of 12 microns (0.0005") thick.

Layers of semiconducting material can be adhered to metal substrates in which case the lossy material can be magnetic in loss characteristics. See, for example, Anderson, U.S. Pat. No. 4,283,427.

The above referenced heaters can take one of several forms, for example a continuous thin-film coating, islands of thin-film coating, pellets or thick layers adhered to a substrate.

A number of containers have been proposed for browning or searing the surface of the food and fall into three general categories. The first are those which include an electrically resistive film, for example tin oxide, usually less than about $1\times10^{-5}$ cm to $2\times10^{-5}$ cm thick that is applied to the surface of a nonconductor such as a ceramic dish and described, for example, in U.S. Pat. Nos. 3,853,612; 3,705,054; 3,922,452 and 3,783,220. Heat is produced because of the $I^2R$ loss (resistive loss). This system is not acceptable for use in the invention primarily because of the bulk, weight and cost of the dish and its breakability. Ceramic dishes, with lossy coatings used in a microwave oven are relatively expensive. A second type includes a microwave energy absorber formed from a mass of particles that become hot in bulk when exposed to microwave energy. The microwave absorbing substance can be composed of ferrites, carbon particles, etc. Examples of these are described in U.S. Pat. Nos. 2,582,174; 2,830,162; 3,302,632; 3,773,669; 3,777,099; 3,881,027; 3,701,872 and 3,731,037 and German Pat. No. 1,049,019.

The third category is exemplified by the currently used commercially available disposable heater uses a polyester layer with a very thin metal layer thereon. Such heaters substantially change heating characteristics during operation, which can be a detriment in some food preparation situations. Another problem, for example, with the metallized heaters, is that they tend to change with time perhaps through an oxidation process and therefore their performance characteristics can vary which can also result in different cooking results.

The metal coated polyester films as disclosed by Seiferth and Brastad are generally incapable of sustained, consistent suscepting in that the metal coated polyester surfaces break up under ordinary microwave heating or cooking conditions at which point suscepting by the metal coated film (i.e. preferential microwave power absorption) is much reduced or ceases.

The above-described first two types of supplemental heaters, as discussed, generally exhibit one or more problems in their use or manufacture particularly when the heater is meant to be disposable.

The ceramic dishes with tin-oxide coating are too expensive, too bulky, require warm-up time, are breakable and retain heat for a long time so as to be inconvenient to handle and use.

The second type of heaters is too bulky or expensive for practical use as disposable heaters, i.e. one which is used once and then disposed of.

The above types of heaters can be difficult to make and can be expensive to manufacture and can require sophisticated manufacturing equipment. Further, there can be limits on the types of materials used as lossy substances and the substrates onto which lossy material is applied e.g. commercially available metallized heaters use very smooth surfaced substrates like polyester.

A major drawback of these heaters is that they can produce a significant contrast or nonuniformity in temperature across the surface, providing uneven cooking results. A solution to the nonuniformity problem, amongst other things, can be found in U.S. patent application Ser. No. 119,381 to Dan J. Wendt et al, the disclosure of which is incorporated herein by reference. The Wendt invention has provided, amongst other things, an effective means to improve temperature uniformity of heaters by using an additional element.

The art also discloses non thin film heaters, for example that disclosed by U.S. Pat. No. 4,190,757 to Turpin which uses a relatively thick lossy layer. Thick heaters can be costly and difficult to manufacture.

The Turpin, et al. device must be thick (0.016" to 0.125") to be effective. The resulting structure, while very effective in heating foods needing crisping such as pizza, is massive, slow to heat, and too expensive to be acceptable as a disposable food package. It also used microwave shielding for the food so that during the time needed to get the susceptor materials up to operating temperature to brown or crisp the food, the food was not overcooked.

Ideally, a susceptor should be capable of very rapidly reaching and then maintaining a suitable susceptor and food surface temperature without having to separately preheat the susceptor as commercially available microwave browning dishes require.

Different foods have different suscepting needs—for example, popcorn vs. pizza. Also, the same type of food may have different suscepting needs due to its shape and/or differences in its thickness. Also, it may be desirable to absorb less power at the edges of a susceptor than toward its center in order to get good heating in the center without overheating at the edge.

An effective and economical means of controllably varying susceptor performance is clearly of great value.

By the selection of electrical and/or magnetic loss properties for the lossy layer as hereinafter taught, power penetration depths can be achieved in the lossy layer which permit intermediate thickness susceptor layers which will produce a range of heat to heat a wide variety of foods in a microwave oven, achieving the aforedescribed suscepting function. The invention also provides means for producing heaters with a predetermined temperature profile across the surface in an easy and effective manner and allows production of heaters with processes and machinery that provide both speed and economy and which are readily commercially available, reducing the need for designing and building complicated or specialty processing lines. Further, within the invention range of thicknesses, variation of power absorption across the lossy layer thickness due to interference effects as a result of reflections within the microwave absorbing layers, is minimal.

It has been found that by the proper selection of materials, their electric and magnetic properties (defined together in the term power penetration depth), and appropriate thickness, a heater can be provided which overcomes many of the above problems. When the lossy material is applied in liquid form during manufacture, a thin layer is provided which after solidifying (curing) has sufficient lossy characteristics to heat food. After application of the lossy material to a suitable substrate, the materials cure, i.e. a portion of the vehicle either evaporates or changes form to provide a nonliquid coating. The coating can be applied in a continuous film, in the form of a grid or in the form of an array of discrete discontinous areas separated from one another or in patterns of preselected thickness and/or materials or combinations thereof.

The substrate can be any material which has sufficient thermal stability, as it relates to, for example, objectionable discoloration, odor, degradation, etc., to withstand the operating temperature of the heater. This includes both substrates that are relatively microwave transparent such as paper, paperboard, plastics and other polymers and also substrates that are microwave reflective such as aluminum foil.

An object of the present invention is to provide a microwave heater which is easy to manufacture by one or more of several liquid coating techniques. Another object of the present invention is to provide a heater which can be made by a process which allows forming a predetermined patterned lossy layer to provide either uniformity of heating or a predetermined heating distribution, something which current commerically available heaters have not been able to achieve. A still further advantage of the present invention is to provide a heater and a heater making process which allows easy changing of the performance characteristics by changing separately or in combination either the proportions of the coating lossy material(s), the type(s) of lossy material, the thickness of the lossy layer or the vehicle. A further object of the present invention is to provide a lossy layer which can be applied to a broader range of substrates than other forms of microwave heater lossy layers. Another object of the present invention is to provide a heater and method of manufacture which allows a wide range of operating characteristics including heaters which are substantially interactive with the microwave by electrical field induced heating or with magnetic field induced heating or combinations thereof. Another object and advantage of the present invention is that heater performance characteristics can be varied for greater latitude in heater performance characteristics desired for optimum food preparation or reconstitution. A still further object of the present invention is to provide a microwave heater which is stable as it relates to dimensions and/or to operating characteristics during heating. Another object of the present invention is to provide a microwave heater which has lossy layer thickness that provides ease of manufacturing. Another object of the present invention is to provide a microwave heater which can utilize a broader range of materials for substrate material and lossy layer material than some of the currently available heaters.

FIGS. 18–23 inclusive are tricoordinate charts showing absorption, transmission and reflection values for various heaters as hereinafter described.

Figure 24:
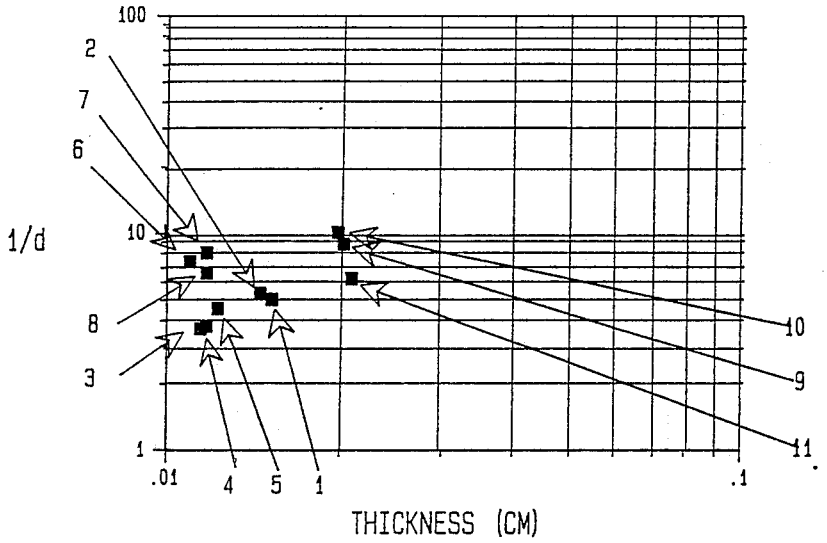

FIG. 24 is a graph on log-log coordinates showing the inverse of penetration depth as a function of thickness.

FIG. 25 illustrates a surface temperature profile for a microwave heater. The temperature, in °C., is depicted next to the coding key. The listed temperatures are the boundary temperatures for each coded area.

Figure 26:
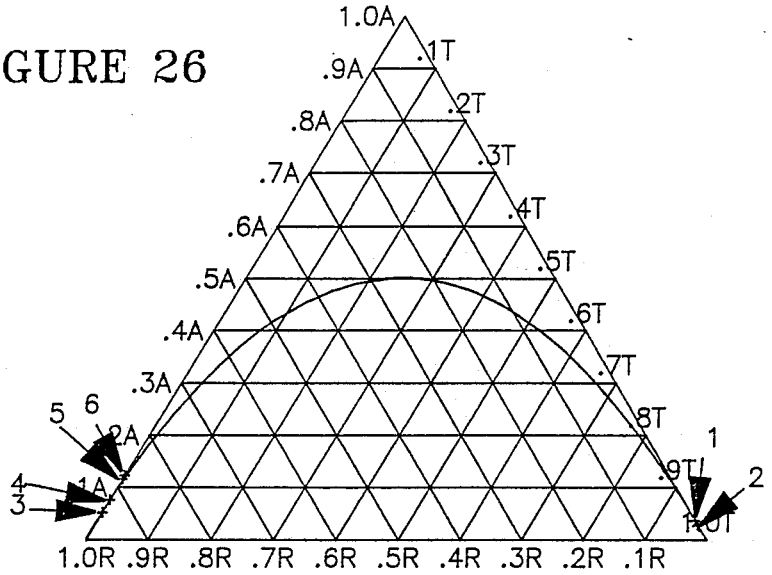

FIG. 26 is a tricoordinate chart showing values for absorption, transmission and reflection for microwave heaters as hereinafter described.

Figure 27:
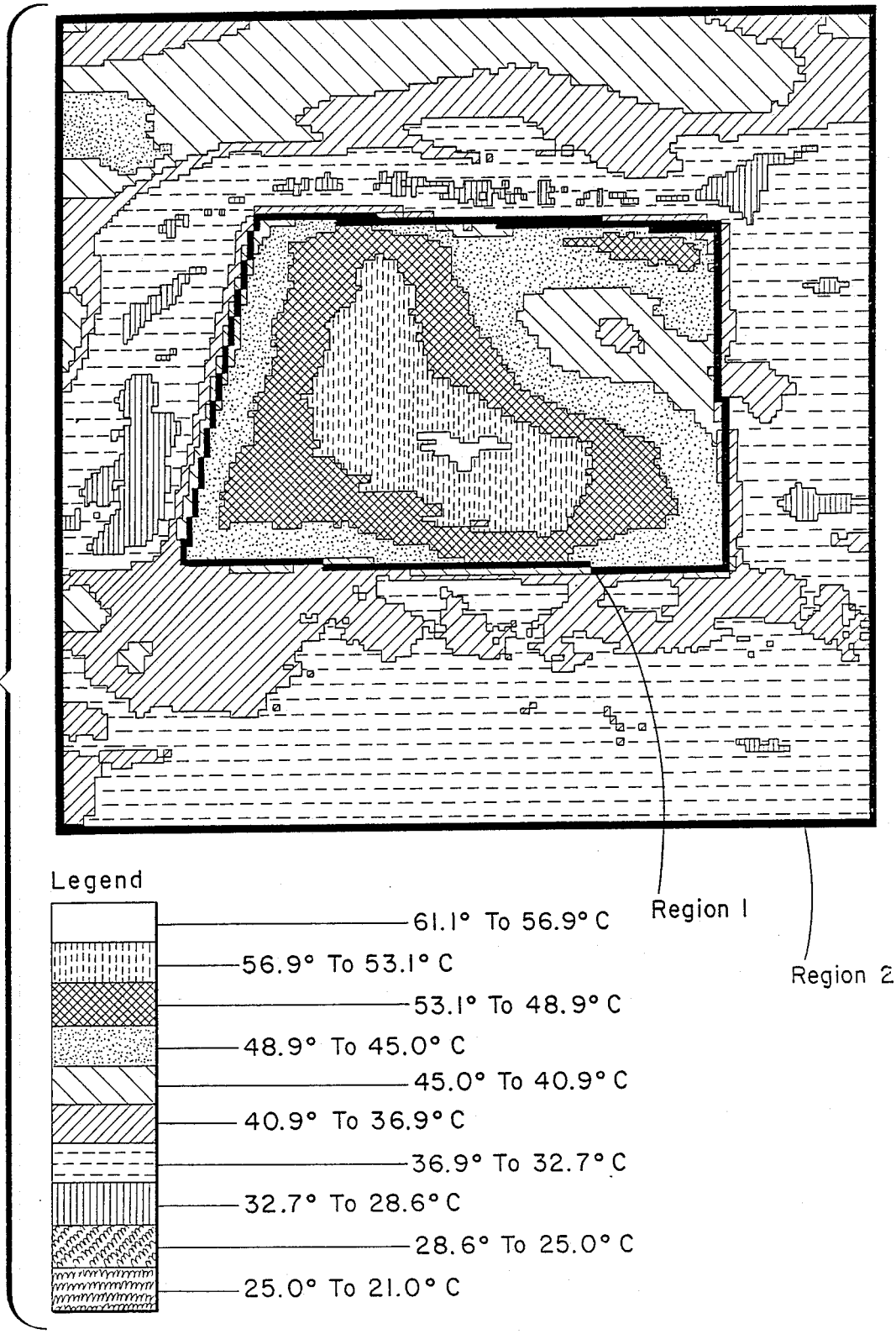

FIG. 27 is a surface temperature profile chart for a microwave heater. The temperature, in °C., is depicted next to the coding key. The listed temperatures are the boundary temperatures for each coded area.

Figure 28:
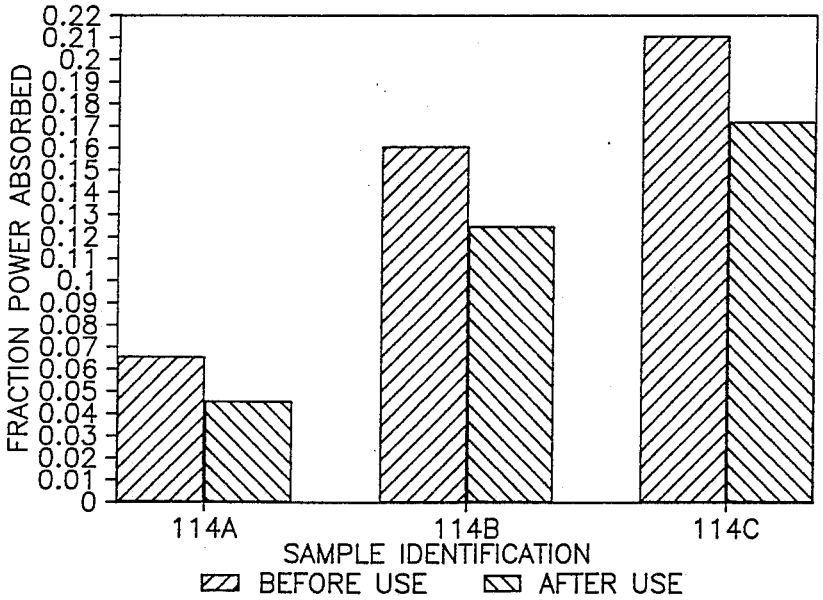

FIG. 28 is a bar chart showing percent power absorbed for various heaters before and after use or exposure to microwave radiation.

Figure 29:
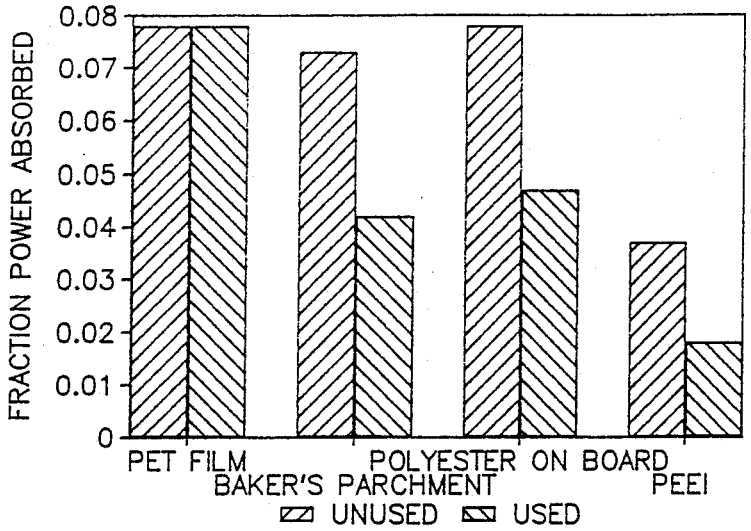
Figure 30:
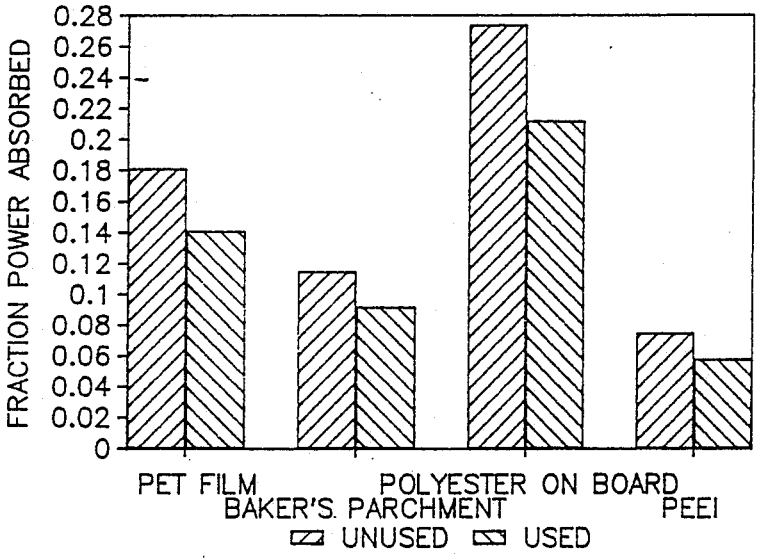
Figure 31:
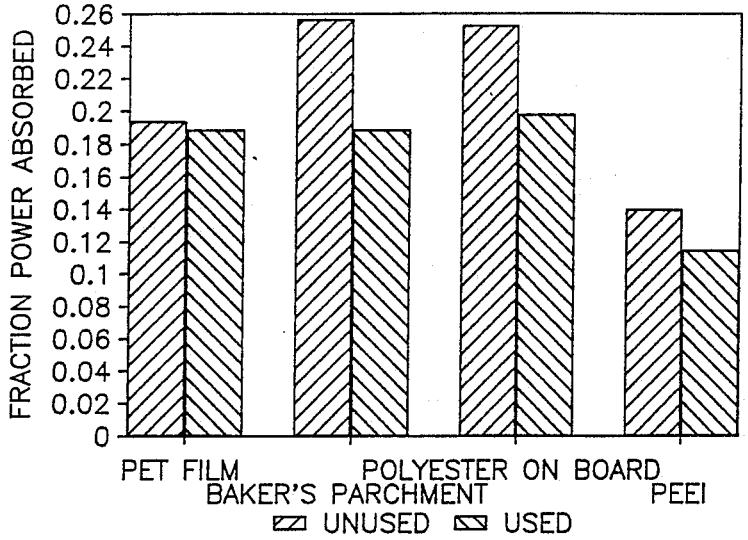

FIGS. 29–31 inclusive are bar charts illustrating fraction power absorbed for different types of heaters before and after exposure to microwave radiation.

Figure 32:
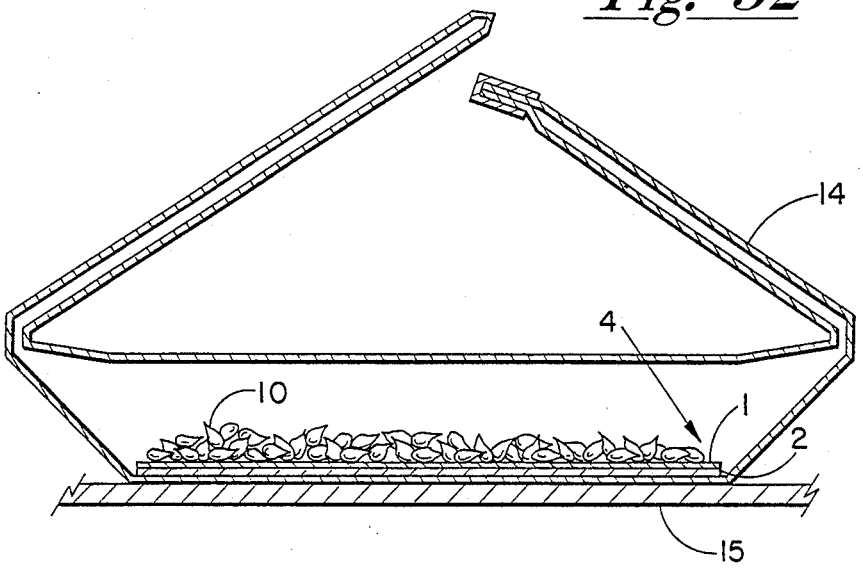

FIG. 32 is a side elevation cross-section view of a popcorn bag for use in a microwave oven.

Figure 33:
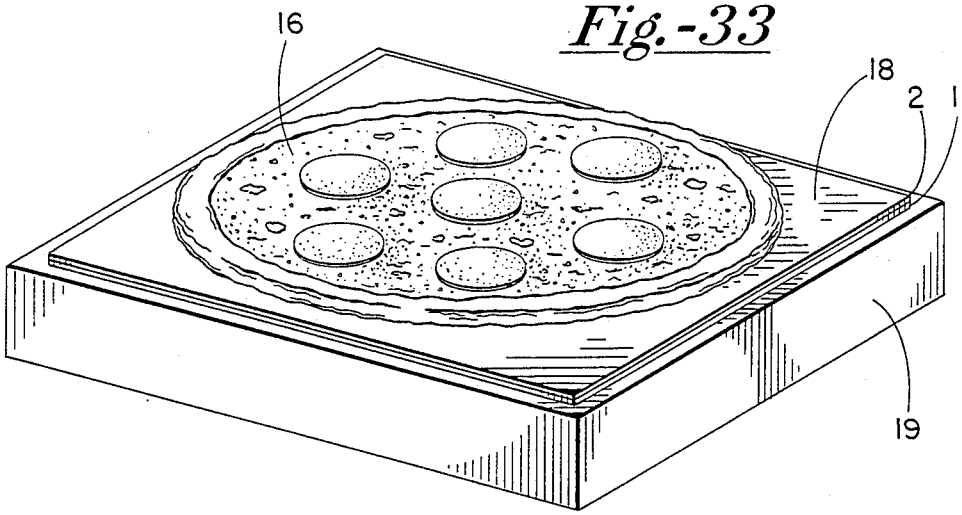

FIG. 33 is a perspective view of a microwave heater having a pizza thereon.

FIGS. 34–37 inclusive are log-log graphs showing in pictorial form the invention in terms of inverse power penetration depth as a function of susceptor layer thickness.

Figure 38:
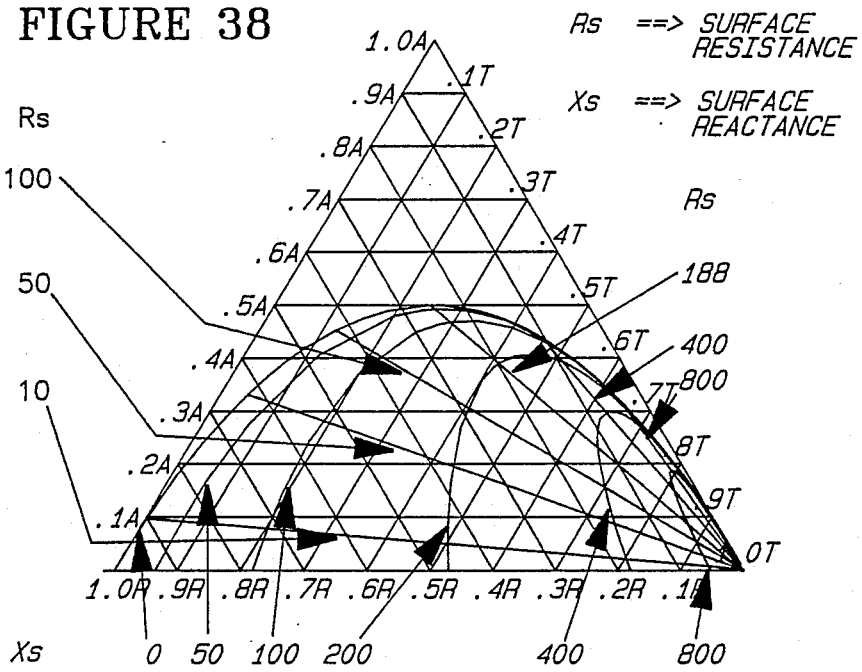

FIG. 38 is a tri-coordinate graph which shows how susceptor resistance and reactance affect heater operating characteristics.

Figure 39:
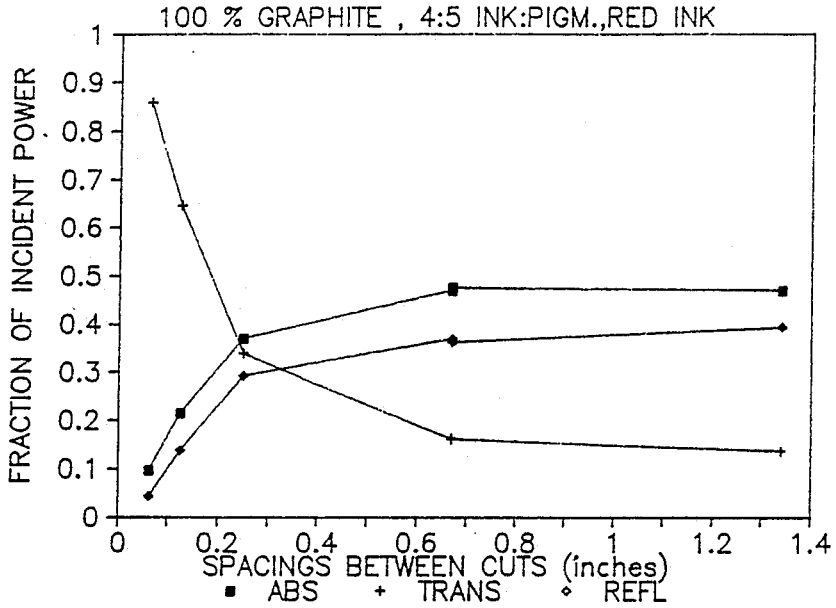

FIG. 39 is a graph showing a functional relationship between fraction of incident power and spacing between cuts.

Figure 40:
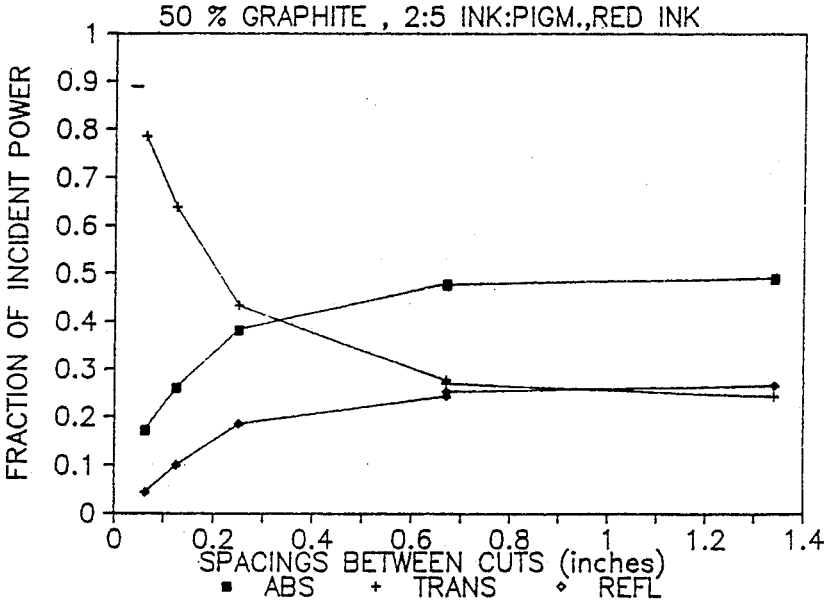

FIG. 40 is a graph showing a functional relationship between fraction of incident power and spacing between cuts.

Figure 41:
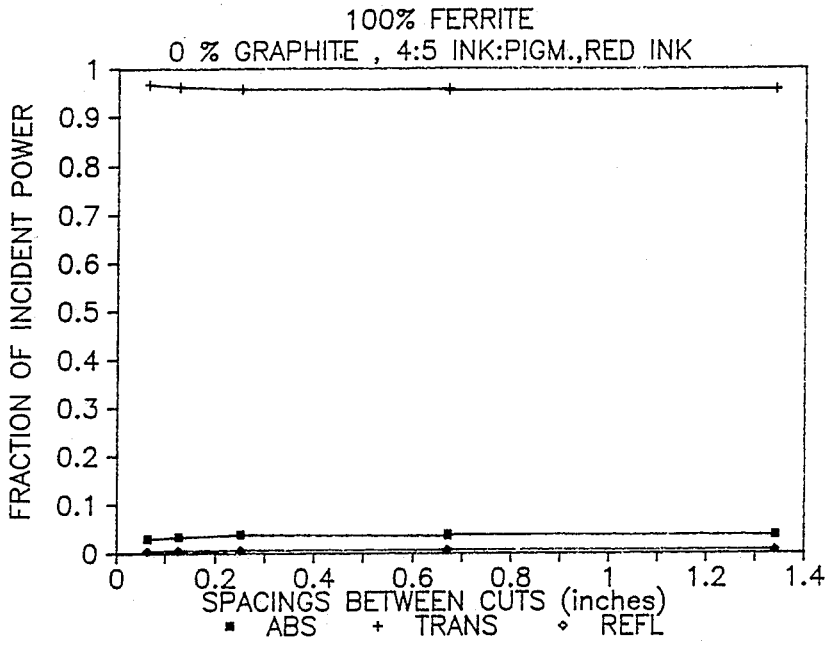

FIG. 41 is a graph showing fraction of incident power as a function of spacing between cuts.

Figure 42:
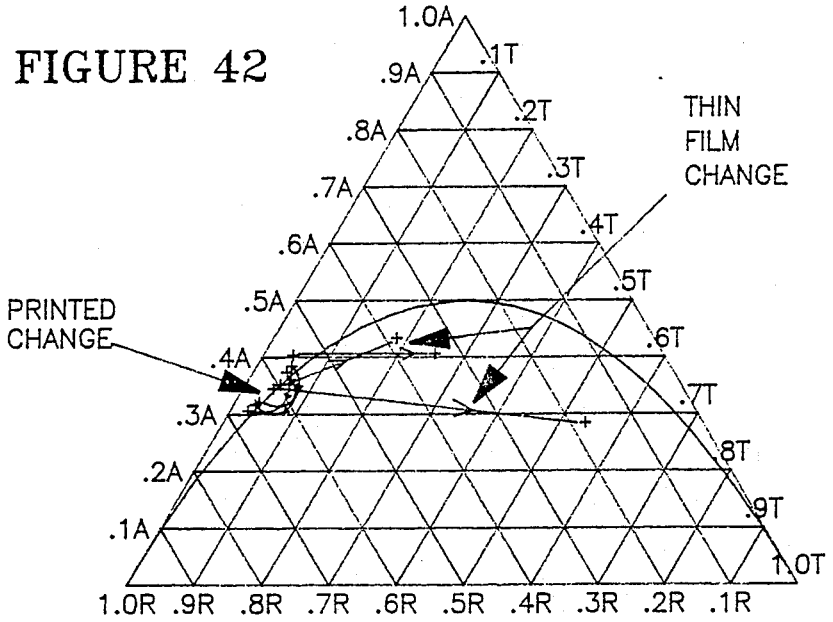

FIG. 42 is a tri-coordinate chart showing change in operating characteristics for an invention heater and the change in operating characteristics for a thin film metallized prior art heater, the change being induced by the heating in a microwave oven of the susceptor with food product thereon.

DETAILED DESCRIPTION

Any suitable lossy material which on its own will interact with the electric field, magnetic field, or in combination with both fields to produce heat, can be utilized in the suscepting layer 2.

The susceptor means may be characterized according to the power penetration depth of the material(s) comprising the cured or solid susceptor layer hereinafter referred to as the susceptor or lossy layer. Penetration depth is the distance over which the microwave power density entering the lossy layer diminishes to 36.8% of its original value. A discussion of power penetration depth can be found in *Industrial Microwave Heating* by Metaxas and Meredith published by Peter Peregrinus Ltd, 1983, the entire disclosure of which is incorporated herein by reference. $\gamma$ is the propagation constant for the susceptor material. Re[$\gamma$] is the real part of the complex propagation constant. Using Maxwell's equations for plane waves, the real portion of the propagation constant may be determined, for purposes of this invention, based upon the following:

$$Re[\gamma] = Re\left[\frac{i2\pi}{\lambda_0}\sqrt{(E' - iE'')(\mu' - i\mu'')}\right]$$

$$\lambda_m = \frac{2\pi}{Im\,[\gamma]} = 2\pi/\left[Im\left[\frac{i2\pi}{\lambda_o}\sqrt{(E' - iE'')\,(\mu' - i\mu'')}\right]\right]$$

The values for the real and imaginary parts of the complex relative permittivity, E′ and E″ respectively, as well as the values for the real and imaginary parts of the complex relative permeability, $\mu'$ and $\mu''$ respectively, may be measured for a particular susceptor material. Hewlett Packard Product Note No. 8510-3 gives a method and instrumentation to determine E′, E″, $\mu'$, $\mu'$, $\mu''$. Im[$\gamma$] is the imaginary part of the propagation constant. $\lambda_O$ is the free space wavelength at the microwave oven operating frequency and $\lambda_m$ is the wavelength in the susceptor layer at room temperature. Unless otherwise indicated all properties are at room temperature, 21° C., and all percents are by weight. At the oven operating frequency of 2.45 GHz used throughout the United States and elsewhere, $\lambda_O$ is about 12.24 cm. Microwave frequencies at which the invention can be practiced are within the range of between about 0.5 and about 30 GHz. The power penetration depth may then be calculated, based on the following relationship:

$$d = \frac{1}{2Re[\gamma]}$$

where d is the power penetration depth, and Re[$\gamma$] is the real part of the propagation constant for the susceptor layer. A measure of the loss or lossiness of a susceptor layer may be though of as being proportional to the inverse of power penetration depth or 2Re[$\gamma$]. As can be seen in FIGS. 34–37, the lower limit of inverse power penetration depth is inversely related to the lossy layer thickness. That is, the thicker the coating the lower the permissible or usable inverse power penetration depth. In each of the Figures, a lower limit for inverse power of penetration depth is shown. As shown, the susceptor layer, as cured, preferably has an inverse power penetration depth (1/d) of greater than about 0.01 $cm^{-1}$ and a more preferred inverse power penetration depth for the susceptor layer is greater than or equal to about 0.012 $cm^{-1}$.

The approximate boundary values for inverse power penetration depth and lossy layer thickness for the invention are shown in FIGS. 34–37.

For the purposes of the invention, the inverse power penetration depth incorporates both electrical and magnetic material properties. If the susceptor layer is not magnetically active the magnetic values are $\mu'=1$ and $\mu''=0$. If not electrically active then $E'=1$, $E''=0$. Other than these two special cases, the susceptor layer properties as measured in a network analyzer will have both magnetic and electric terms. The equation used to calculate the inverse power penetration depth uses both electric and magnetic terms. They can be combined in any relative magnitude and are treated alike.

When there are two or more layers of materials comprising the lossy layer the power penetration depth or the inverse power penetration depth, can be easily calculated as above for a single lossy layer. This can be done by measuring the E', E'', $\mu'$ and $\mu''$ values in the network analyzer for the composite layer and using these effective or composite values in the above equations.

The susceptor means preferably has a low thermal mass. A preferred susceptor means should heat quickly when exposed to microwave radiation and cool quickly after the microwave power is turned off. A susceptor having a large thermal mass can result in an excessively long heating time and can burn a person handling same. This could cause a number of problems, e.g., the food can overcook thru its own loss properties before the susceptor reaches the desired temperature, excessive overall cooking time, the need to preheat the susceptor, etc.

In addition to the inverse power penetration depth, the thickness of susceptor layer is very important. In order to be both manufacturable on the state of the art liquid coating and printing processes, and be lossy enough at that thickness to preferentially absorb microwave energy and convert that energy into heat, the operable thickness of the invention is in the range of between about 0.001 cm and about 0.025 cm.

As can be seen in FIGS. 34–37, the invention is defined graphically. The area A shows the approximate operable ranges for thickness and inverse power penetration depths of the invention. Area A is defined by connecting the indicated intersections on the log-log graph with straight lines. Area A is limited by a minimum approximate inverse power penetration depth range and a minimum and maximum approximate thickness. The upper limit of area A for inverse power penetration depth is unbounded. A preferred form of the invention is defined by the approximate area B, also not having an upper limit, a more preferred form of the invention is defined by the approximate area C and a most preferred form of the invention is defined by the approximate area D.

The thickness of the coating should be in the range of between about 0.001 centimeters and about 0.025 centimeters (area A), preferably in the range of between about 0.002 centimeters and about 0.025 centimeters (areas B and C), and more preferably in the range of between about 0.0025 centimeters and about 0.02 centimeters (area D).

The susceptor preferably is inexpensive and disposable. In such applications, the packaging is not intended for reuse. Moreover, for convenience, the packaging should not require a separate preheating step.

It is to be understood that some food products may use different susceptor lossiness levels than other foods to be more effectively cooked in the microwave oven. Each food will have a preferred operating range dictated by the attribute to be achieved and the relative lossiness of the food. The most effective means to establish the preferred range for a specific food product is to make susceptors with a range of properties and use these to prepare the food product. The food products are evaluated and, taking directions from these evaluations, the susceptor performance characteristics can be adjusted as disclosed herein to improve the food product attributes. The preferred susceptor property range is the one that gives the best product performance for a specific product.

The invention is particularly useful in this approach because the mixtures of inert particles such as low loss pigment-like materials such as $TiO_2$ and active particles, and vehicles are easily varied to change the lossiness of the susceptor layer. The thickness is easily changed by the application method and/or number of coatings applied. A susceptor or a set of susceptors can be prepared with this invention in the laboratory using a simple silk screen press. In comparison, doing the same thing with vapor deposited films requires special chambers, targets and expertise to prepare samples large enough to test food.

The active or lossy particles as incorporated into the susceptor can be of a non planar shape. The particles are generally randomly distributed and can be in touching or in electrical conductivity relationship. Particularly in the higher loss coatings, the active particles, when used with microwave transparent substrates, are primarily the electrically active particles that provide resistive ($I^2R$) heating. Because these particles touch, a DC conductivity can be measured. The same particles or magnetic particles in a similar random orientation at low values of inverse penetration depth sometimes do not exhibit DC conductivity.

Particles are used that typically have longest surface dimension (L) to thickness (t) ratio L/t of $<8$. Many of the ferrites used approach L/t of 1 since they are generally spherical particles.

Electric field interactive materials can be selected from the class of metals and semiconductors. Metals are characterized as having bulk conductivities greater than $10^4$ (ohm-cm)$^{-1}$. Semiconductors are characterized by having bulk conductivities between $10^{-9}$ (ohm-cm)$^{-1}$ and $10^4$ (ohm-cm)$^{-1}$. Materials having bulk conductivities less than $10^{-9}$ (ohm-cm)$^{-1}$ are commonly called "insulators" and are of no interest as electrically active materials (see *Reference Data For Radio Engineers*, 5th edition by Howard W. Sams & Co. 1973, pgs. 4–21, the disclosure of which is incorporated by reference).

Materials that can be used as a lossy substance or interactive material can be placed in several groups. Those groups include: semiconductors, ferromagnetic materials, dielectric materials and period 8 oxides. Some specific materials within these groups include: silicon, ferrites, metals and their alloys, graphite, carbon, etc. Preferred materials include graphite, powdered or granular ferrite and powdered or granular $Fe_3O_4$. Other materials are disclosed in U.S. Pat. No. 4,190,757, the entire disclosure of which is incorporated herein by reference.

The active heating ingredient of the microwave energy absorbent layer is any suitable lossy material applied in layer form that will heat faster or to a temperature higher than the temperature of a food product surface thereon and preferably higher than about 100° C. when in cooking heat transfer relationship with the food in a microwave oven. It is preferred that the lossy material be in fine particulate form, for example being less than 200 microns in size. The active particles used can be described as spherical or ellipsoidal particles. Typically, the largest dimension to thickness ratio is less than 8. The particles are preferred to be either nearly spherical or if ellipsoidal in shape to be oriented randomly so as not to create a preferential alignment of particle axes. The heater 4 is comprised of a substrate 1 onto which the active heating or susceptor layer 2 is applied. It is understood that the susceptor layer can be sandwiched between two layers of substrate and still be effective.

In the present invention, the substrate 1 may be either transmissive of microwave energy there through to the food or reflective when the transmission of microwave energy to the food is not desirable yet where surface heating is desirable. The substrate can be any suitable material e.g., transmissive materials include paper and paperboard and reflective materials include metal. Whenever the microwave energy impinges on a metal surface, the electric field strength in a direction tangent to the metal surface falls to zero at the metal surface and the magnetic field strength is a maximum at the metal surface. A standing wave is created by the reflected wave such that the electric field strength tangent to the surface reaches a maximum and the magnetic a minimum one quarter wavelength from the reflective surface. A susceptor layer heats due to the electric and/or magnetic electric and/or magnetic fields that lie in the plane of the susceptor surface. When a susceptor layer that heats due to interacting with the electric field is placed adjacent to a metal, only minimal heating may be achieved. When the heating mechanism is predominantly electrically derived, it is preferred to place the susceptor coating on substrates that are substantially microwave transparent. If, however, the heating of the coating is primarily as a result of the magnetic field, the coating may be applied directly to metal substrates and still achieve desirable heating.

As disclosed by Wendt et al, a metallic grid or an array 20 can be used as a component of a heating element. The heater 4 is placed within a package or container 22 of any suitable form. A food product is placed in heat transfer relation to the heater 4 and preferably is placed directly thereon for conduction of heat from the heater into the food product.

It is further desirable that the wavelength of the microwave energy in the susceptor layer be large compared to the actual susceptor layer thickness. With this condition, the energy distribution through the susceptor layer thickness will be more uniform. This occurs when the lossy layer thickness to wavelength in the lossy layer ($t/\lambda_m$) is less than or equal to about 0.15.

A liquid slurry or suspension is made, much like paint or other coatings by combining the lossy material(s) and, if desired, inert filler material(s) with a vehicle.

A vehicle performs the functions of binder and solvent, with in some cases (such as when co-reacting epoxy-amine resins are used) the same material performing both functions.

The function of the solvent is to provide suitable viscosity and flow characteristics as needed to apply a coating.

The function of the binder is to bond the lossy material(s) and optional inert filler(s) together into a solid coating and bind the solid coating to the substrate.

Numerous materials can serve as binders, including such simple materials as starch e.g. wheat starch, as well as complex materials such as air dry polyacrylate lacquers and co-reacting epoxy-polyamides and epoxy-amines.

Numerous materials can also serve as solvents, such as water, alcohols, aliphatic hydrocarbons, esters and ketones.

In practice, blends of solvents are frequently used to achieve appropriate evaporation or curing rates along with the necessary viscosity for efficient application by the chosen method. Also, complete removal or reaction of solvents is often desirable.

In a preferred form of the invention, the coating of binder, solvent, lossy material and optional microwave inert filler material is applied in liquid form and the coating or layer is cured into a solid layer, i.e. a non-liquid layer. This can be done by chemical reaction such as with an epoxy or the evaporation of the solvent as with an acrylic based or starch based system. This provides advantages over the type of heater as disclosed by Winters et al, U.S. Pat. No. 4,283,427, which requires the presence of the solvent at least initially during heating in order for the heater to be functional when exposed to microwave radiation.

It is to be understood that materials used in the heater composite should be safe for use with food products. Also, the lossy layer can be separated from the food with a food safe intermediate layer such as paper, paperboard, polyester, etc.

The mixture of vehicle, inert material (if any) and lossy material should form a liquid having a viscosity appropriate for the particular application technique employed.

The slurry, after application to a suitable substrate, should be such that it will cure and form an integral matrix either through chemical curing of the binder or loss of the solvents. After curing, the particles that interact with the microwave field may be in sufficient electrical contact to provide DC conductivity. Curing can be accelerated by heating of the slurry on the substrate after application.

Any suitable liquid application method can be utilized. For example, electrostatic coating, spraying, rolling, dipping, printing, coating, etc. Such application techniques are known in the liquid application industries. A particularly desirable form of application is by silkscreen printing techniques. Printing techniques allow patterning of the lossy material in varying thicknesses or type of lossy material or density or leaving areas devoid of lossy material. Subsequent or sequential passes through a silkscreening process can provide a patchwork effect allowing preselected or predetermined areas or regions to be coated with different materials and/or thicknesses. Another application technique is any coating technique such as air knife, trailing blade, etc. as is known in the art.

Any suitable substrate, which is thermally stable at the operating temperature of the heater with the food thereon, can be utilized. Such materials can include plastic sheets, paper, paperboard, metal foils, metal pans, etc.

An important aspect of the present invention is its ability to provide differential or controlled heating in preselected or predetermined areas or regions of preselected or predetermined sizes across the susceptor layer major surface. Commercially available, metallized heaters tend to heat predominantly at the edge and are cooler toward the center. The severity of the edge heating effect generally becomes more pronounced as the lateral dimensions of the susceptor are increased to cook larger food items. When used with food e.g., pizza, this can provide unacceptable cooking by not cooking the center of the pizza as much as the peripheral edge. The heating characteristics, or the temperature profile, across the surface of the susceptor of this invention can be easily adjusted by adjusting certain properties of the lossy layer to provide a preselected or predetermined temperature profile. This is done by providing one or more preselected or predetermined nonuniformities in the lossy layer across a major surface thereof as hereinafter described. This provides preselected regions having different preselected levels of responsiveness to microwave radiation. Three properties of the layer can be changed either singly or in any combination to provide the desired temperature profile.

The three variables or properties of consideration are: the inverse power penetration depth or lossiness of the lossy layer portion within the above described ranges; the thickness of the lossy layer within the above described ranges; and the sizes or size of preselected areas, regions or portions of the lossy layer when the lossy layer is in patterns as described above.

The liquid lossy layer material can be applied to the substrate or to a previously applied lossy layer in any pattern or sequence. For example, the lossy layer can be a continuous layer, or in the form of a grid, or in the form of an array, or in combinations of grids and arrays, or in combinations of arrays of different materials, or in grids or arrays of different materials. Some of these forms are shown in FIGS. 1–17 inclusive. The lossy material(s) can be applied in a substantially uniform thickness, a non-uniform thickness or in patterns with varying thickness to provide predetermined areas of selected lossiness. For example, a thicker layer of lossy material in the center will provide a higher temperature in the center than a thinner layer in the same location. Thicker strips can also be utilized to provide for example, a hot grill effect on the cooked product. The lossy material(s) can be applied either as a substantially uniform material across the surface of the heater or the lossy layer can include different materials positioned in preselected or predetermined positions or regions and/or thicknesses to control or adjust the temperature profile of the heater to provide a predetermined, preselected or desired heating or temperature profile across the heater.

Figure 14:
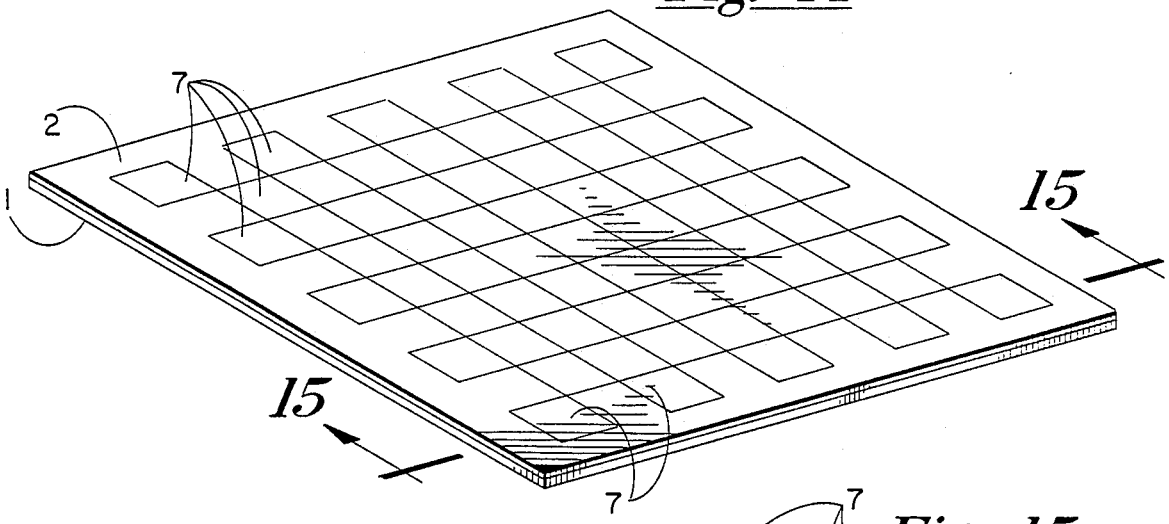
FIG. 14 is a perspective view of a microwave heater showing a microwave heater wherein the susceptor layer has a plurality of different materials positioned in preselected positions.
Figure 15:
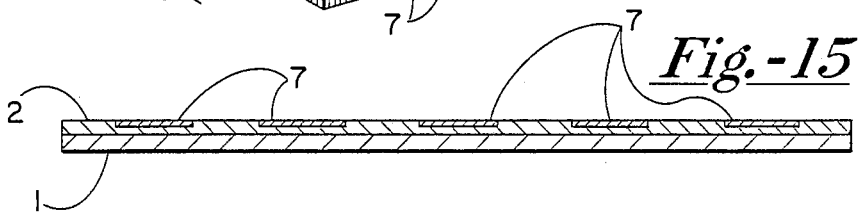
FIG. 15 is a cross-sectional view of the heater of FIG. 14 taken along the line 15—15.

It has also been found that the temperature profile across a heater can be adjusted or controlled to provide a predetermined, preselected or desired heating or temperature profile across the heater by providing different sized areas of lossy layer portions or regions. For example, the squares or other shapes of lossy layer portions as shown in FIGS. 14 and 15 can have preselected sizes at preselected locations. The sizes can be variable from region to region in the lossy layer or there can be two or more different size regions provided. Area or region size can be used to control the temperature of that particular susceptor layer area portion when the susceptor layer is exposed to microwave energy. As can be seen in FIGS. 39–41 that region size will determine operating temperature. When a region or area has its major and minor axes, if they are different in size, both in excess of about 1.6 cm (for 2450 MHz radiation, with proportionately larger dimensions for longer wavelength radiation), an increase in dimension does not result in a significant increase in temperature. Also, when both major and minor axial dimensions of a region are reduced below about 0.16 cm (for 2450 MHz radiation), power absorption in that region is reduced such that in field strengths typical of domestic microwave ovens the susceptor operating temperature is reduced below levels useful for cooking food. From a functional standpoint these regions can be considered to be in a non-heating condition. Therefore, when an area has its major and minor axes between about 0.16 and 1.6 cm (for 2450 MHz radiation), changes in region size will significantly affect the susceptor operating temperature over a range practical for cooking food. The invention can therefore be used to provide a desired temperature differential between pre-selected areas or regions. Having the preselected sizes of areas or regions in preselected locations can provide for a differential temperature or to provide a uniform temperature across the lossy layer surface. It can also be seen that the regions can be made sufficiently small that, for practical purposes, they do not interact sufficiently with the microwave field to produce sufficient heat for cooking food. Thus, from a functional standpoint these areas are in a non-heating condition. Thus, if it were desired to heat the center of a susceptor heating a food item, the larger susceptor areas would be placed in the center while smaller areas would be positioned where a lower susceptor temperature would be desired. This invention also provides a way to compensate for the uneven lateral temperature profiles found in commercially available susceptors; utilizing this invention, a very uniform temperature or a predetermined temperature profile across the susceptor surface are possible.

The size and shape of the lossy areas or regions can be controlled when the lossy layers are deposited (e.g. by printing) on the substrate, or by mechanical disruption (e.g. by cutting or stamping) of the lossy layer after it has been deposited on the substrate and cured.

FIGS. 39, 40, and 41 illustrate the effect of cut spacing for susceptors of this invention. For the experiments shown in these Figures, long parallel cuts were made with a sharp knife in the lossy layer of each susceptor; the distance in inches between cuts is shown on the Figures' horizontal axes. To measure reflection, transmission, and absorbence, a susceptor sample is clamped between flanges connecting two sections of waveguide, which in turn are connected to a network analyzer. In the rectangular waveguide used for these experiments, at 2450 MHz, the electric field vector is oriented across the long axis and perpendicular to the larger cross-sectional dimension of the guide. The field within the waveguide is therefore polarized and this must be properly considered when making and interpreting these measurements. In general, the susceptor should be mounted so that the major (long) axis of the cuts or electrical discontinuities are oriented parallel to the long dimension of the waveguide cross-section. For complex patterns of electrically connected and disconnected areas, or where multiple layers have been deposited along different dominant directions, or where the predominant cut orientation is otherwise ambiguous, successive network analyzer readings can be taken as the susceptor is rotated to numerous angular positions between the waveguide flanges. The angular position of the susceptor giving minimum power absorption is used for value measurement.

FIGS. 39, 40, and 41 show the effect of cut spacing for three different susceptor formulas. The long parallel cuts in each susceptor's lossy layer were oriented parallel to the long axis of the waveguide cross section. FIGS. 39 and 40 show similar absorption, reflection, and transmission characteristics as a function of cut spacing for two graphite-based susceptor formulations. Both of these susceptors show little additional change in absorption, reflection, or transmission when the distance between cuts is increased above about 1.6 cm (0.625 inch). FIG. 41 shows that when a 100% ferrite formula is used, spacing between cuts had no effect on microwave absorption, reflection, or transmission apparently because of its initially high transmission.

This phenomena is further illustrated in FIG. 38. As seen in this Figure, constant surface resistance lines are straight and converge at a point representing 100% transmission. Constant reactance lines are curved. By cutting or providing other forms of electrical discontinuities or disruptions between areas, the reactance of the susceptor can be changed. Reactance can be measured in a network analyzer as disclosed in pending patent application entitled "Susceptors Having Disrupted Regions For Differential Heating In A Microwave Oven", by Jon Kemske, et al., filed contemporaneously herewith the entire disclosure of this application is incorporated herein by reference. By putting cuts into the susceptor lossy layer, the reactance of the susceptor layer is increased. Thus, for a given surface resistance the susceptor becomes more transmissive while both absorption and reflection generally decrease. This then provides an effective means of temperature control. If the lossy layer has an initially high transmission, then further changes in the susceptor by cutting will not result in a very large change in reactance and therefore absorption and reflection will remain generally the same as demonstrated further in FIG. 41.

The above test procedure used to generate the figures immediately above discussed was done in a waveguide with a network analyzer where the electric field is polarized. However, in a microwave oven the electric field is random and cuts should be made in two directions to separate the lossy layer into discreet elements to accommodate the randomness of the field.

It is to be understood that if very narrow spacings are between cuts and the cuts are parallel, a substantial portion of the randomly oriented electric fields in the microwave oven cannot effectively be absorbed or be available for heating thus also providing a reduction in susceptor temperature. However, if a microwave oven exhibits polarization, proper orientation of the heater in the oven may result in heating of the heater.

The different size regions can be provided by the printing process by printing separate patches or regions which are electrically disrupted therebetween or discontinuous or the lossy layer can be made electrically discontinuous for example, by cutting the lossy layer to provide an electrical discontinuity.

From the foregoing it can be seen that the present invention provides control mechanisms for providing a predetermined temperature profile which is unavailable in commercially available heaters. U.S. Patent Application to Kemske, et al., discussed above, the entire disclosure of which is incorporated herein by reference, discusses the use of region size to control temperature profile.

The following is a description of various forms of microwave heaters which can be made in accordance with the teachings of the present invention.

Figure 1:
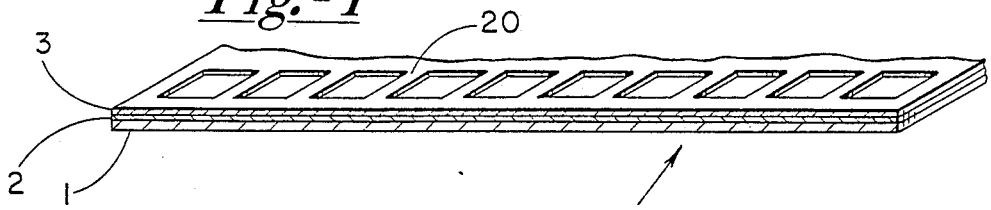
FIG. 1 is a sectional perspective view of a microwave heater with certain layers thereof shown exaggerated in thickness.

FIG. 1 illustrates a microwave heater 4 having a substrate 1 which is preferably thermally stable as discussed above. Positioned on and preferably bonded to the substrate 1 is a susceptor or lossy layer 2. As known in the art a protective layer 3, which can be made of polyester or other sheet material, is positioned on the layer 2 and preferably bonded thereto. It is preferred that the layers 1, 2 and 3 be a laminate. The susceptor layer 2 is made in accordance with the foregoing teachings and is comprised of the binder or vehicle having the lossy material contained therein. A grid 20, as disclosed by Wendt, can be suitably secured to the heater 4 if desired. The heater 4 along with a food product can be placed in any suitable container or package 22.

Figure 2:
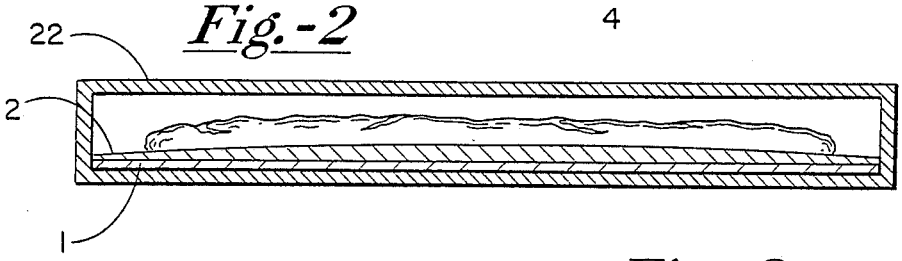
FIG. 2 is a side elevation view of a microwave heater showing certain layers thereof exaggerated in thickness, the top layer having a varying thickness with the thickest portion being in the center and the thinnest portion being at the edges.

FIG. 2 shows a modified form of the present invention where the susceptor layer 2, positioned on the substrate 1, has a varying thickness across its width and/or length. As shown, the susceptor layer 2 is thicker in the middle than on the edges. This can provide, as discussed above, a temperature profile that is preselected or predetermined. In general a thicker lossy layer will provide a higher temperature for a given penetration depth.

Figure 3:
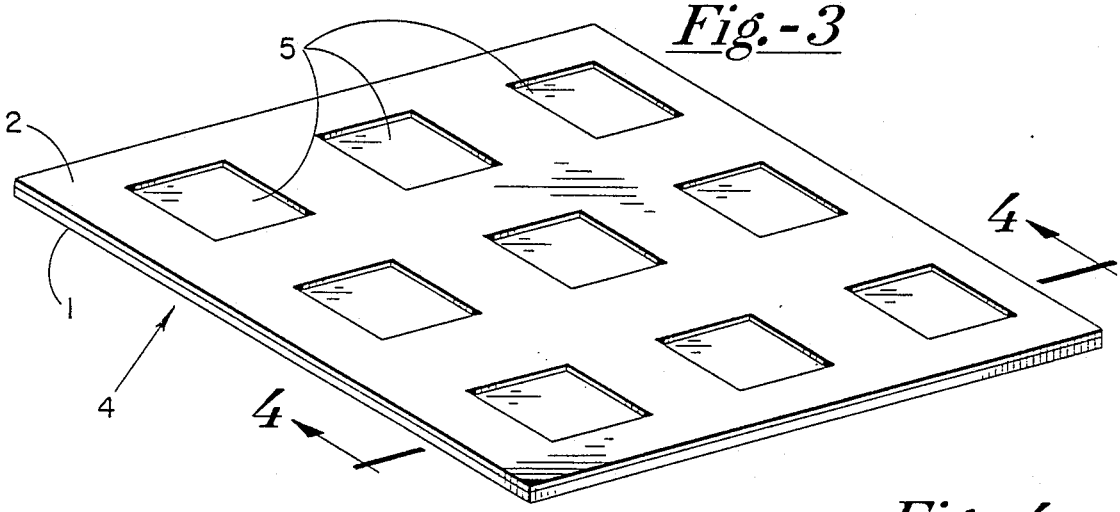
FIG. 3 is a perspective view of a microwave heater having the susceptor layer with multiple thicknesses in selected areas.
Figure 4:
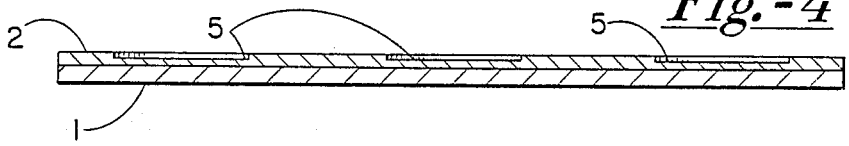
FIG. 4 is a cross-sectional view taken along the line 4—4 of FIG. 3.

FIG. 3 shows a heater having a substrate 1 with a susceptor layer 2 thereon. As seen in FIGS. 3 and 4 the susceptor layer 2 has a pattern of preselected or predetermined location and/or sized thin areas formed by recesses 5 in the susceptor layer 2. It is to be understood that the recesses 5 can have different depths and the depth can be equal to or less than the thickness of the layer 2.

Figure 5:
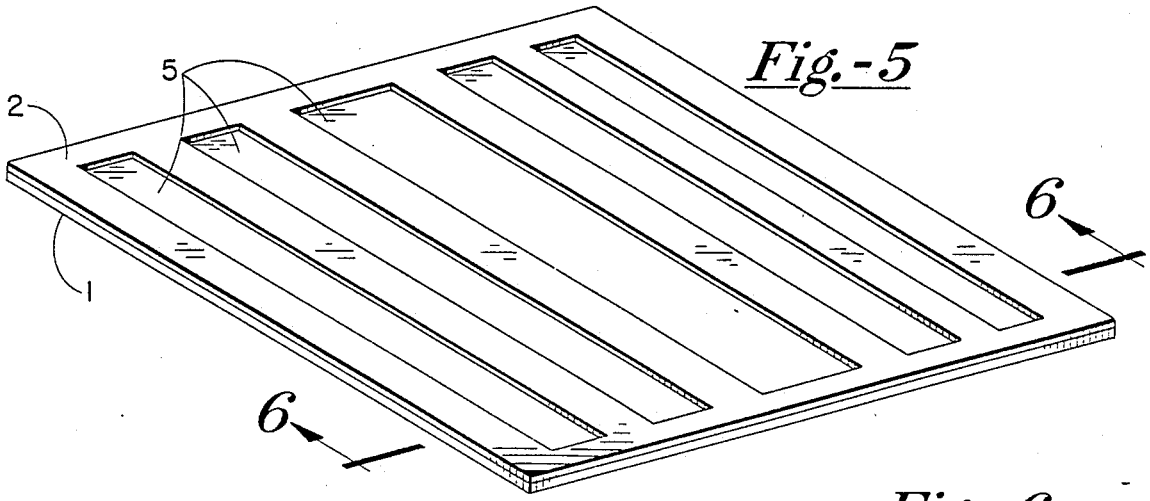
FIG. 5 is a perspective view of a microwave heater having the susceptor layer with multiple thicknesses in selected areas.
Figure 6:
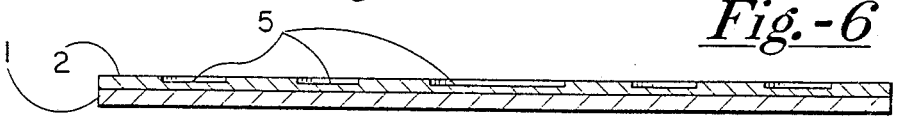
FIG. 6 is a cross-sectional view of the heater of FIG. 3.

FIGS. 5 and 6 show a different arrangement of recesses 5. In the form of the invention shown in FIGS. 5 and 6, the recesses are elongated slots in a parallel arrangement, while in FIG. 3 the recesses are in a checkerboard or rectangular lattice arrangement of rows and columns to form an array.

Figure 7:
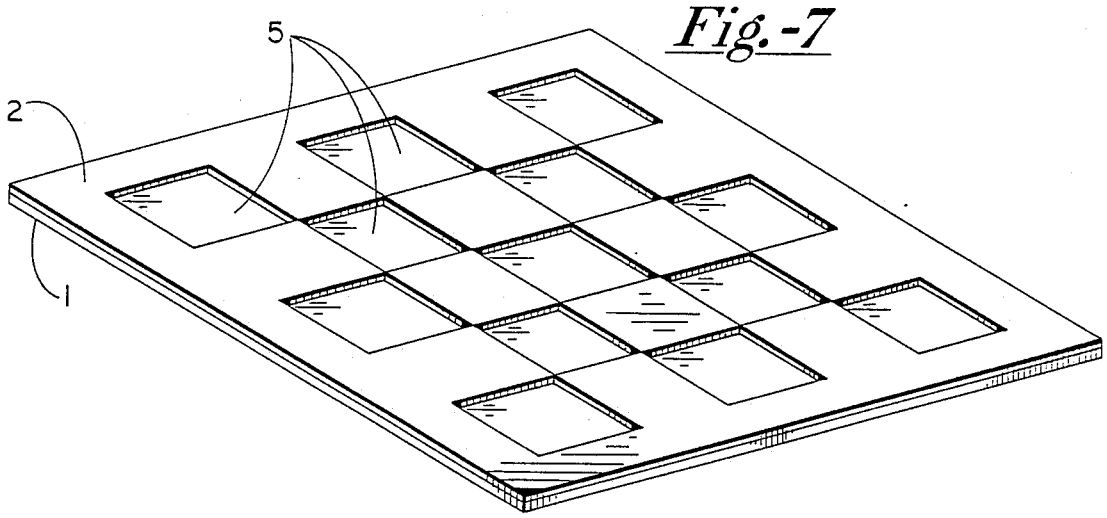
FIG. 7 is a perspective view of a microwave heater having the susceptor layer with multiple thicknesses in selected areas.

FIG. 7 shows a microwave heater having the recesses 5 in an array in a staggered lattice arrangement.

Figure 8:
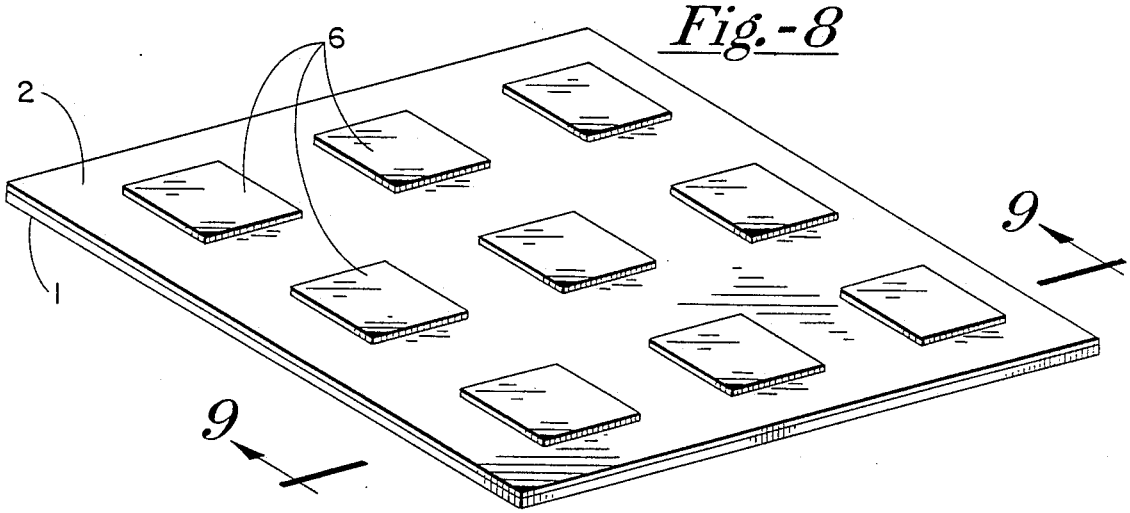
FIG. 8 is a perspective view of a microwave heater having the susceptor layer with multiple thicknesses in selected areas.
Figure 9:
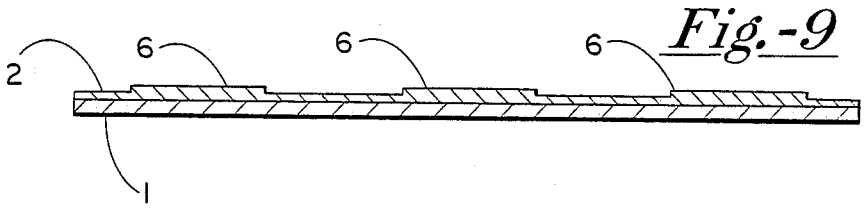
FIG. 9 is a cross-sectional view taken along the line 9—9 of FIG. 8.
Figure 10:
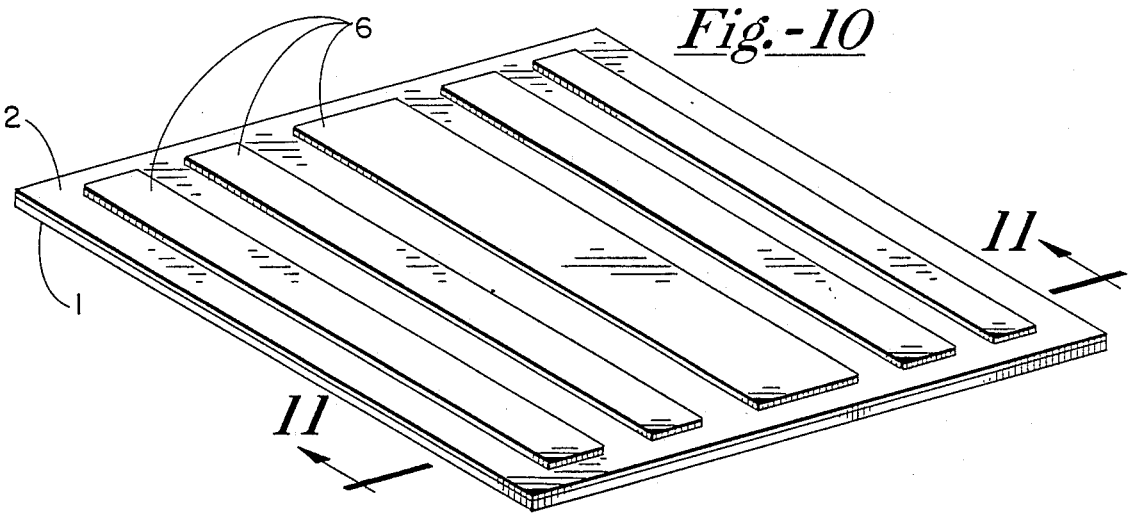
FIG. 10 is a perspective view of a microwave heater having the susceptor layer with multiple thicknesses in selected areas.
Figure 11:
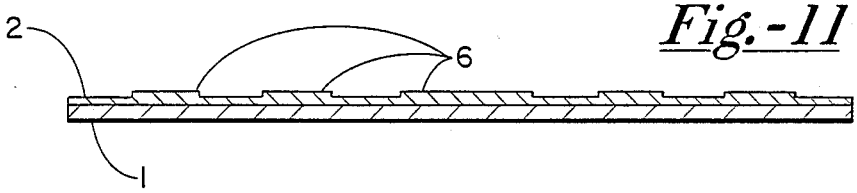
FIG. 11 is a cross-sectional view taken along the line 11—11 of FIG. 10.

FIGS. 8 and 9 show a microwave heater having a plurality of protuberances or thick areas 6 projecting from the exposed surface of the lossy material 2. In the particular form of the invention shown in FIG. 8 the protuberances 6 are in a rectangular lattice arrangement. Likewise, FIGS. 10 and 11 show protuberances 6 which are in parallel strips. The thickness of the protuberance 6 in FIGS. 10 and 11 can be equal or different as can the lengths.

Figure 12:
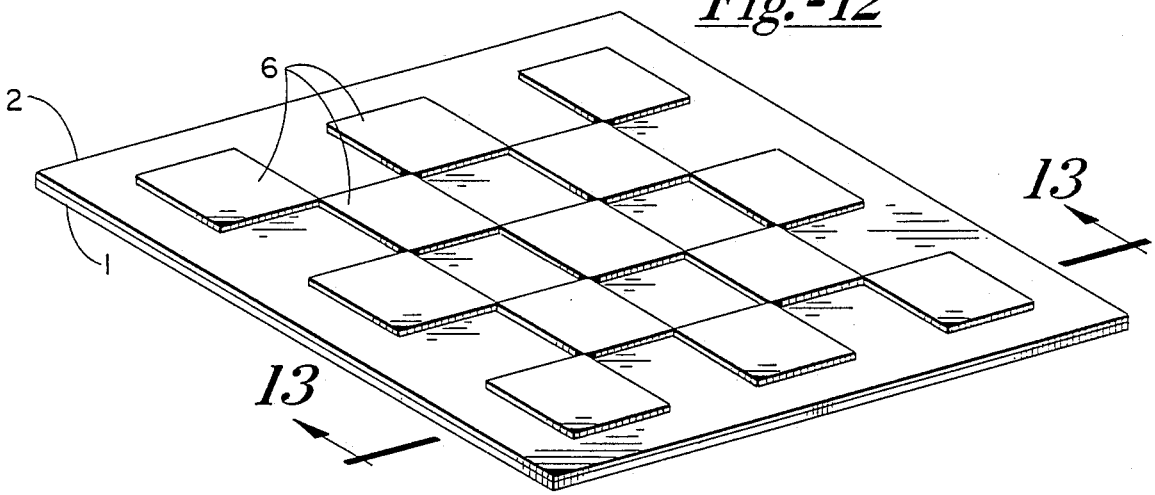
FIG. 12 is a perspective view of a microwave heater having the susceptor layer with multiple thicknesses in selected areas.
Figure 13:
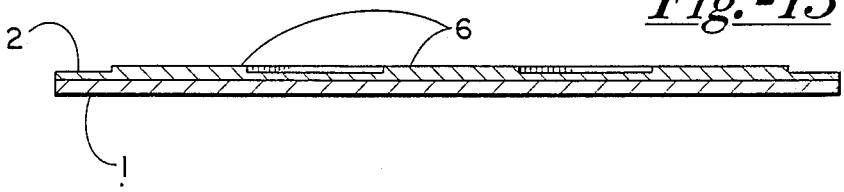
FIG. 13 is a cross-sectional view taken along the line 13—13 of FIG. 12.

FIGS. 12 and 13 illustrate another form of heater with protuberances 6 projecting from the lossy layer 2. In this case the protuberances are in a staggered lattice arrangement.

FIGS. 14 and 15 illustrate another form of the present invention. In this form, the susceptor layer is a staggered lattice arrangement of areas wherein selected areas 7 can have a different material to provide differential heating. The areas 7 are embedded in the lossy layer 2 and are lossy themselves. Because of a difference in thickness and/or material relative to the remainder of the lossy layer 2, differential heating can be provided by the areas 7. Any suitable arrangement and/or shape and/or size of areas 7 can be utilized.

Figure 16:
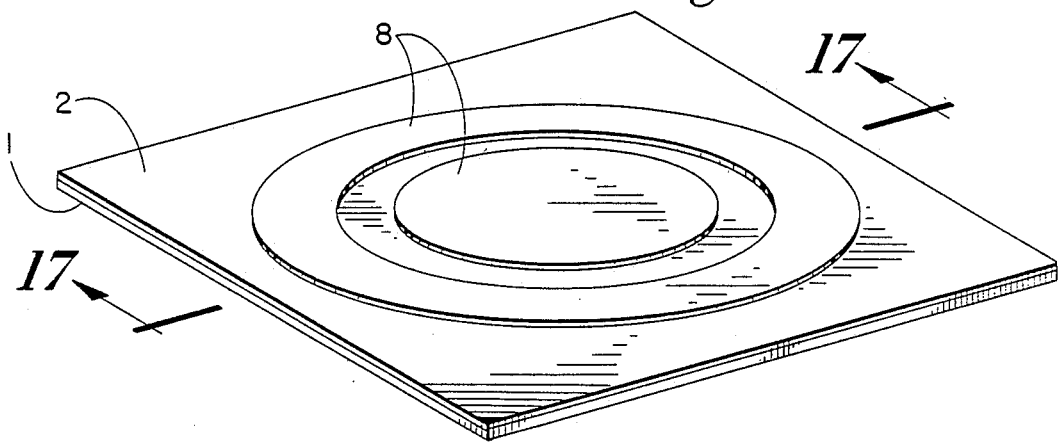
FIG. 16 is a perspective veiw of a microwave heater having the susceptor layer of different thicknesses with the different thicknesses being shaped in preselected shapes and sizes.
Figure 17:
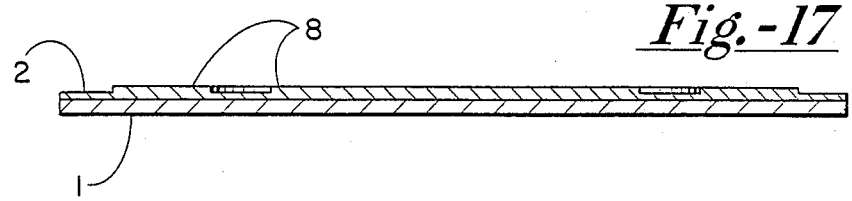
FIG. 17 is a sectional view of the heater of FIG. 16 taken along the line 17—17.

FIGS. 16 and 17 show a microwave heater having concentric circular protuberances 8 on the exposed surface of the lossy layer 2. The protuberances 8 can be the same material as the lossy layer 2 and are also lossy themselves. They can be a different material than the lossy layer. This will provide differential heating because of the different thickness and/or the difference in type of material.

As shown in FIG. 32 a popcorn bag has popcorn kernels 10 contained within a bag 14. The popcorn bag 14 can be any suitable type as are known in the art. A heater 4 is provided and has the lossy layer 2 and a substrate 1. The popcorn kernels rest on the lossy layer. It is to be understood that a protective layer 3 can also be provided. To provide thermal insulation or the like a corrugated pad 15 can also be provided for positioning under the popcorn bag during exposure to microwave radiation.

FIG. 33 illustrates another form of the present invention, a tray type heater 19. The upper surface 18 is a heater comprised of a lossy layer 2 and a substrate 1, which substrate can be an integral portion of the tray 19. A pizza 16 or the like is positioned on the heater and is in heat transfer relationship with the lossy layer 2. It is to be understood that a protective layer 3 can also be provided.

As described above the lossy layer 2 can take many forms and should fall within the described boundaries of inverse power penetration depth and lossy layer thickness. However, not all portions of the lossy layer 2 are required to fall within these boundaries. It is desired that the lossiness and thickness criteria be followed for that portion of the heater which is in the most direct heat transfer relationship with the product. For example, marginal portions or peripheral edge portions of the heater extending beyond the food need not necessarily fall within the criteria since it is not providing appreciable heat to the food surface of interest. Also, it is pointed out that portions of the lossy layer 2 can fall outside of the defined ranges with the lossy layer 2 still providing sufficient heat to the food product. It is desired that a substantial portion of the lossy layer which is in most direct heat transfer relationship with the food product surface, be within the above described ranges for inverse power penetration depth and thickness. More preferably, a majority of the lossy layer 2 in most direct heat transfer relationship with the food product surface in contact or most adjacent thereto, be within the above defined regions of inverse power penetration depth and lossy layer thickness.

It is also to be understood that the lossy layer can have its inverse power penetration depth changed in several ways. Some of the properties of the lossy layer which can affect inverse power penetration depth include: the density of the lossy layer 2, the active material in the lossy layer 2, the type of vehicle, the type of binder, the size of discreet regions in the lossy layer 2, the amount of active ingredient in the lossy layer, types of active material(s) and their relative ratios and the relative amount of inert material in the lossy layer. Any of these individually or any combination thereof can be used to control or adjust the inverse power penetration depth of the lossy layer.

EXAMPLES

The graphite used for all examples was graphite powder from Sargent-Welch Scientific Company, technical grade, SC12517-500GM.

Table 1 gives the electric and magnetic properties of ferrite powders used in the following examples. The materials were obtained from Titan Corp. and were measured in a network analyzer in a packed powder state.

TABLE 1

| FERRITES FROM TITAN CORPORATION | | | | | |
|---|---|---|---|---|---|
| E' | E'' | $\mu'$ | $\mu''$ | Penetration depth (cm) | $\lambda_m$ (cm) |
| FCX-1276 | | | | | |
| 5.873 | 0.076 | 1.281 | 1.035 | 0.923 | 4.185 |
| FCX-1277 | | | | | |
| 6.991 | 0.064 | 1.394 | 0.834 | 1.068 | 3.774 |
| FCX-1278 | | | | | |
| 6.620 | 0.036 | 1.543 | 1.078 | 0.912 | 3.640 |
| Uncoded | | | | | |
| 3.198 | 0.047 | 0.882 | 0.932 | 1.197 | 6.601 |
| FCX-1510 | | | | | |
| 6.303 | 0.268 | 1.329 | 1.577 | 0.613 | 3.782 |

FIGS. 18 through 31 show various performance characteristics of heaters. The following is a tabulation of the formulas used in the following examples.

The ferrite used for the formulas in Table 2 was black iron oxide pigment, $Fe_3O_4$, from Wright Industries Incorporated, except where otherwise specified.

TABLE 2

| Identification | COMPOSITION BY PERCENT WEIGHT* | | | Coating Thickness | |
|---|---|---|---|---|---|
| Code | Graphite | Ferrite | Binder | (cm) | |
| WATER SOLUBLE SILK SCREEN INK: | | | | | |
| A1R | 83.33% | 0.00% | 16.67% | 0.0127 | |
| A3R | 55.56% | 0.00% | 44.44% | 0.0098 | |
| C2R | 35.71% | 35.71% | 28.57% | 0.0091 | |
| E1R | 0.00% | 83.33% | 16.67% | 0.0121 | |
| E3R | 0.00% | 55.56% | 44.44% | 0.0083 | |
| | | | | THICK COATING | THIN COATING |
| DA1 | 33.33% | 50.00% | 16.67% | 0.0103 | |
| DB1 | 21.67% | 61.67% | 16.67% | 0.0108 | |
| DC1 | 8.33% | 75.00% | 16.67% | 0.0097 | |
| DA3 | 22.22% | 33.33% | 44.44% | 0.0104 | 0.00165 |
| DB3 | 14.44% | 41.11% | 44.44% | 0.0086 | |
| DC3 | 5.56% | 50.00% | 44.44% | 0.0086 | 0.00183 |
| ACRYLIC BASE SILK SCREEN INK: | | | | | |
| DA3 | 22.22% | 33.33% | 44.44% | | |
| DC3 | 5.56% | 50.00% | 44.44% | | |
| EPOXY BASE COATING: | | | | | |
| None | 66.67% | 0.00% | 33.33% | | |
| ACRYLIC BASE SILK SCREEN INK: | | | | | |
| | | FCX 1278** | | | |
| M1 | 2.65% | 59.52% | 37.84% | | |
| M2 | 6.25% | 56.25% | 37.50% | | |
| M3 | 4.51% | 57.99% | 37.50% | | |
| M4 | 0.00% | 62.50% | 37.50% | | |
| M5 | 11.36% | 51.14% | 37.50% | | |

TABLE 2-continued

| Identification Code | COMPOSITION BY PERCENT WEIGHT* Graphite | Ferrite | Binder | Coating Thickness (cm) |
|---|---|---|---|---|
| | | FCX 1277** | | |
| M6 | 0.00% | 81.97% | 18.03% | |

*WATER EXTENDER IGNORED
**TITAN CORPORATION

EXAMPLE I

In Example I, slurries were formed of various lossy materials utilizing water soluble silk screen ink as a binder. The particular formulas are disclosed in the above tabulation Table 2. In all of the examples in Table 2 the coatings were applied to a drafting polyester approximately 0.0076 cm thick.

Figure 18:
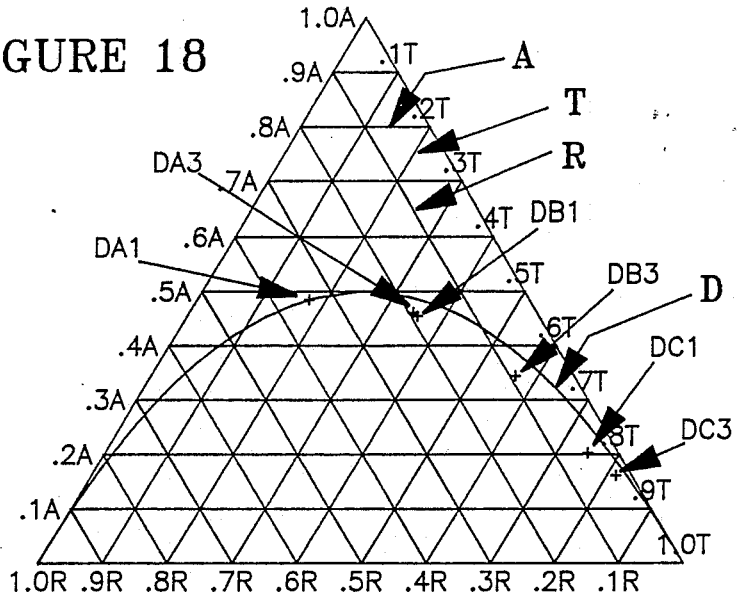

The tricoordinate charts, such as FIG. 18, show properties of the heater with regard to absorption, transmission and reflection of power. In the particular form of chart used, the horizontal lines (A) represent constant levels of absorption, the lines (T) represent constant levels of transmission and the lines (R) represent constant levels of reflection. The sum of the fractions absorption, reflection and transmission at any point on a tricoordinate chart equals 1 or 100%. As used herein, absorption, reflection and transmission are power terms unless otherwise designated. Curve D on the charts represents a theoretical prediction of how a purely electrically resistive heater will react to a microwave field.

FIG. 18 shows the results of network analyzer data using varying formulas of graphite and ferrite in a water soluble silk screen ink. Sufficient water was added to make the composition silkscreenable onto a substrate of polyester. It can be seen that with a change in the formula that the absorption, reflection and transmission of the incident power can be easily changed with a formula change.

It is seen in FIG. 18 that all the network analyzer measured data follows very closely with the predicted performance characteristics for resistive heaters, even though the ferrite used is partly magnetic. It can also be seen that a change in the formula of the lossy material can affect its performance characteristics with regard to power absorption, transmission and reflection.

Figure 19:
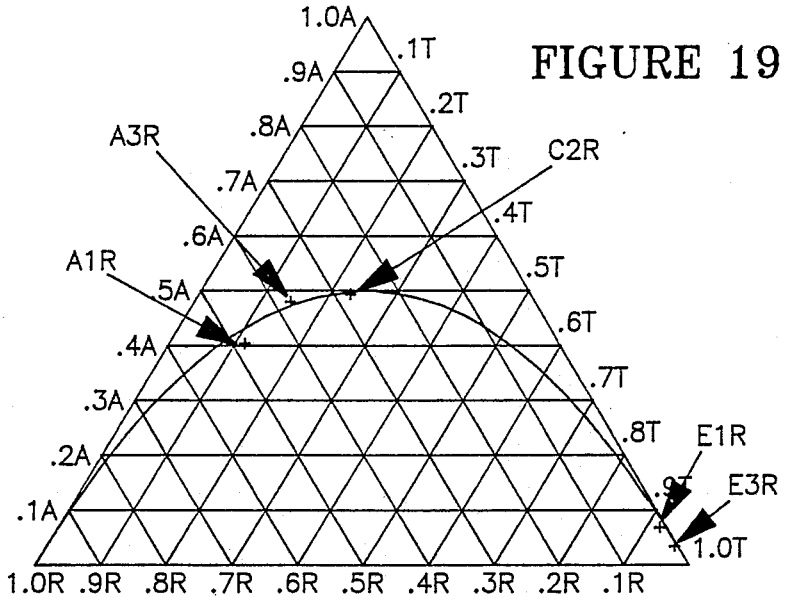

FIG. 19 illustrates the effect of a change in the quantity and type of lossy component. It can also be seen that a change in binder level did not have as much of an effect on performance as a change in type of microwave active material. Table 2 contains the formulas.

Figure 20:
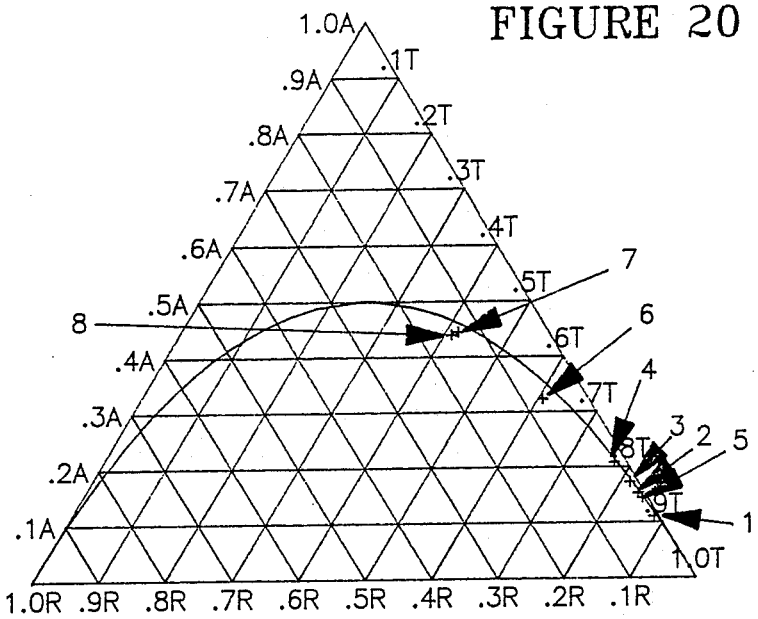

FIG. 20 is a graph showing the use of acrylic ink as the vehicle. The mixtures used are defined in Table 2 identification code DA3. It shows the effect of a change in thickness. Points 6, 7 and 8 are thick coatings while points 1 through 5 are thin coatings. The mean thicknesses of these respective two groups are 0.0057 cm and 0.0016 cm. This graph shows that a decrease in thickness makes the device more transmissive and less absorptive. Also, FIG. 20 shows, when compared to the lossy layers using water soluble silk screen ink vehicles of FIGS. 18 and 19, that the lossy layers using acrylic vehicle results in a susceptor that is slightly less conductive thereby reducing absorption and reflection and increasing transmission.

Figure 21:
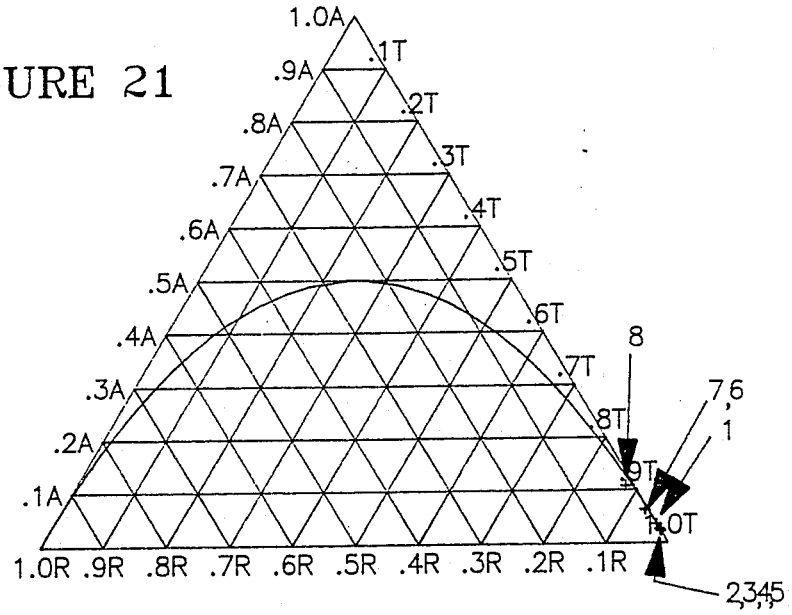

FIG. 21 shows the effect of changing the ratio of graphite to ferrite to change the operating characteristics. Identification code DC3 acrylic base of Table 2 was used. FIG. 21 is to be compared to FIG. 20. When less graphite is present and more ferrite is present the absorption changes less with a change in thickness than when there is more graphite to ferrite.

The thickness of the suscepting coating in the devices of FIG. 21 are listed in Table 3. The data points 1 thru 8 shown in FIG. 21 correspond to the sample number in Table 3.

TABLE 3

| Identification Code | Sample Number | Coating Thickness (cm) |
|---|---|---|
| DC3 | 1 | .0023 |
| DC3 | 2 | .0023 |
| DC3 | 3 | .0015 |
| DC3 | 4 | .0023 |
| DC3 | 5 | .0012 |
| DC3 | 6 | .0071 |
| DC3 | 7 | .0061 |
| DC3 | 8 | .0061 |

Another series of network analyzer data was taken utilizing the mixtures shown as M1 through M6 of Table 2. Table 4 shows the various network analyzer measurements with regard to each one of these samples.

TABLE 4

| E' | E'' | Penetration Depth (d) (cm) | $\lambda_m$ (cm) | $\mu'$ | $\mu''$ | t (cm) |
|---|---|---|---|---|---|---|
| | | M1 | | | | |
| 19.367 | 4.504 | 0.589 | 1.98 | 1.96 | .597 | 0.0137 |
| 19.289 | 4.559 | 0.582 | 2.02 | 1.88 | .602 | 0.0135 |
| | | M2 | | | | |
| 59.348 | 48.245 | 0.161 | 1.08 | 2.03 | .642 | 0.0147 |
| 57.866 | 50.643 | 0.159 | 1.10 | 2.00 | .599 | 0.0142 |
| | | M3 | | | | |
| 31.886 | 12.009 | 0.372 | 1.60 | 1.82 | .565 | 0.0147 |
| 29.537 | 10.581 | 0.381 | 1.61 | 1.94 | .614 | 0.0132 |
| | | M4 | | | | |
| 13.738 | 1.641 | 0.742 | 2.32 | 1.97 | .767 | 0.0147 |
| 13.475 | 1.732 | 0.752 | 2.33 | 2.01 | .749 | 0.0155 |
| | | M5 | | | | |
| 86.485 | 198.833 | 0.067 | 0.69 | 2.34 | .534 | 0.0130 |
| 81.700 | 184.769 | 0.067 | 0.68 | 2.55 | .546 | 0.0140 |
| | | M6 | | | | |
| 21.518 | 2.979 | 0.613 | 1.76 | 2.20 | .717 | 0.0231 |
| 21.162 | 2.886 | 0.621 | 1.81 | 2.13 | .709 | 0.0198 |

Figure 22:
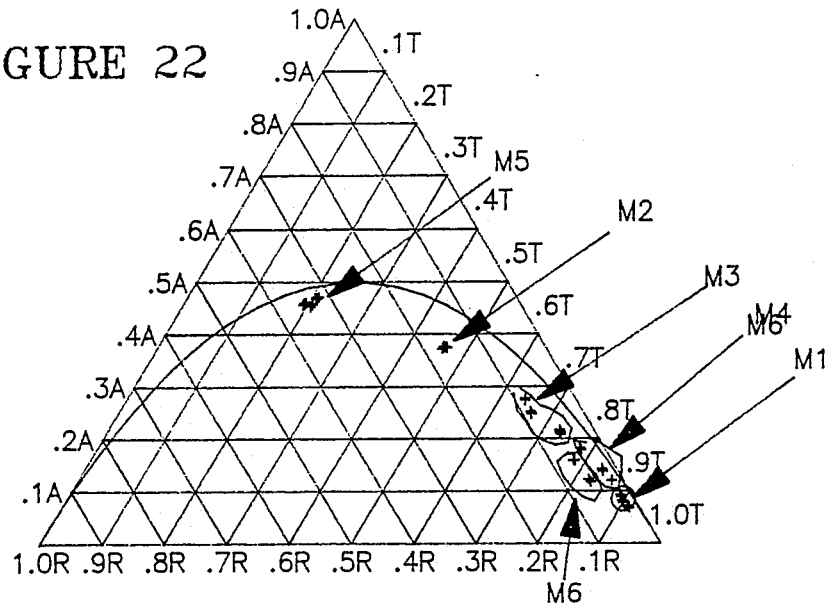

In the immediately preceding chart:
E' = Relative dielectric constant (permittivity)
E'' = Relative dielectric loss factor
d = Penetration Depth (defined above, at 36.8% power density basis)
$\lambda_m$ = Wavelength in the microwave active layer
$\mu'$ = Relative magnetic permeability
$\mu''$ = Relative magnetic loss factor FIG. 22 shows the effect in the change of graphite to ferrite ratios. The formulae are found in Table 2. It can be seen that a change in the ratio affects the performance characteristics of the heater. Also, it can be seen in this data that a change in the amount of binder, as best seen by points M4 and M6, did not have a significant effect on the performance characteristics while a change in the formula had a significant effect on the performance characteristics. Another thing to be noted from FIG. 22 is that when a magnetic material is a portion of the lossy material that the data does not follow the predicted performance characteristic for purely resistive materials (curve D) nearly as closely as when the material is almost entirely nonmagnetic as seen in FIGS. 18, 19, 20 and 21.

EXAMPLE II

Example II illustrates that both coating thickness and formula can be adjusted to control absorption and transmission levels.

For this example two formulas of coating were prepared:

Formula 2M: 5% graphite, 55% ferrite (Titan FCX-1277), 40% acrylic base by weight, wet basis.

Formula 3M: 10% graphite, 50% ferrite (Titan FCX-1277), 40% acrylic base by weight, wet basis.

The coating was applied to a polyester substrate using a silk screening process. After curing, samples were characterized by measuring coating thickness, penetration depth, and reflection, transmission and absorption (Table 5). The tabulated reflection, transmission and absorption values are the parameters measured with a network analyzer in a WR340 waveguide (impedance of 534 ohms) at 2450 MHz.

TABLE 5

| Sample Number | Formula | No. of Coating Layers | Active Coating Thickness (cm) | l/d ($cm^{-1}$) | Reflection | Transmission | Absorption |
|---|---|---|---|---|---|---|---|
| 1 | 2M | 2 | 0.0152 | 4.93 | 0.133 | 0.539 | 0.328 |
| 2 | 2M | 2 | 0.0145 | 5.24 | 0.098 | 0.607 | 0.295 |
| 3 | 2M | 1 | 0.0114 | 3.58 | 0.019 | 0.820 | 0.161 |
| 4 | 2M | 1 | 0.0117 | 3.70 | 0.020 | 0.827 | 0.153 |
| 5 | 2M | 1 | 0.0122 | 4.50 | 0.036 | 0.762 | 0.202 |
| 6 | 3M | 1 | 0.0109 | 7.41 | 0.165 | 0.387 | 0.449 |
| 7 | 3M | 1 | 0 0117 | 8.06 | 0.142 | 0.408 | 0.450 |
| 8 | 3M | 1 | 0.0117 | 6.49 | 0.068 | 0.597 | 0.336 |
| 9 | 3M | 2 | 0.0201 | 8.85 | 0.348 | 0.209 | 0.443 |
| 10 | 3M | 2 | 0.0198 | 10.10 | 0.364 | 0.205 | 0.432 |
| 11 | 3M | 2 | 0.0208 | 6.06 | 0.322 | 0.230 | 0.448 |

Figure 23:
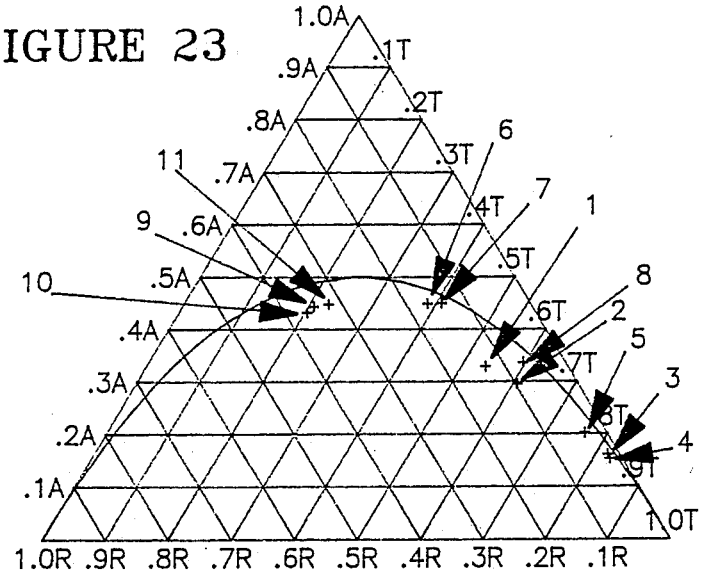

FIG. 23 is a tricoordinate graph of reflection, transmission and absorption properties of these susceptors. FIG. 24 shows inverse power penetration depth and thickness for the samples of Table 5. Numbers on the graph correspond to the sample numbers in Table 5 above. At the 5% graphite formula by weight, wet basis (2M) both absorption and reflection increase as the thickness is increased. When graphite is increased to 10% by weight, wet basis while maintaining about the same coating thickness (3M) samples 6, 7 and 8 demonstrate higher absorption than the comparable samples 3, 4 and 5. As the coating thickness of the 3M formula is increased it becomes more reflective while absorption tends to remain constant.

EXAMPLE III

Example III is provided to illustrate that the temperature profile across the surface of a susceptor layer can be easily and effectively changed. In this particular Example, temperature profiling was accomplished by using a multiple thickness lossy layer. In the particular Example, the center of the susceptor layer was thicker than the peripheral edges.

The susceptor was made by silk screen printing one coating layer onto the polyester substrate followed after curing by a second silk screen application in the center of the first layer over a smaller area. This left an edge which had one layer around the center which had two layers. The formula 2M, as used in this Example, is disclosed in Example 2. Table 6 summarizes the susceptor characteristics.

TABLE 6

| Formula | Region | No. of Coating Layers | Active Coating Thickness (cm) | d (cm) | l/d ($cm^{-1}$) |
|---|---|---|---|---|---|
| 2M | Center | 2 | 0.0152 | 0.181 | 5.525 |
| 2M | Edge | 1 | 0.0104 | 0.194 | 5.155 |

FIG. 25 shows the surface temperature profile of this susceptor when it was heated at constant low power in a variable power microwave oven. The image was produced by infrared thermography. Mean temperatures of the two regions were determined using the infrared camera and computer software more fully identified in application Ser. #119,381, filed Nov. 10, 1987 the entire disclosure of which is incorporated herein by reference. The two layer thick center square shown as AR1 on FIG. 25 shows a mean temperature of 39.7° C., while the single layer perimeter shown as AR2 has a mean temperature of 34.7° C. Thus in a real microwave heating environment it has been demonstrated that different areas of the microwave heating susceptor can be made to heat at different levels.

EXAMPLE IV

Example IV illustrates that the present invention works on both relatively transmissive substrates and on highly reflective, for example metal, substrates.

In this example a coating composed of 57.1% ferrite (Titan uncoded), 38.1% acrylic base and 9.1% water by weight, wet basis was applied to polyester or aluminum foil substrates using a silk screening process. Table 7 shows coating thicknesses, the penetration depth of the coatings on polyester and the reflection, transmission and absorption of the coatings on polyester and aluminum foil as measured by a network analyzer with a WR340 waveguide (impedance of 534 ohms) at 2450 MHz.

TABLE 7

| Sample Number | Substrate | No. of Coating Layers | Active Coating Thickness (cm) | l/d ($cm^{-1}$) | Reflection | Transmission | Absorption |
|---|---|---|---|---|---|---|---|
| 1 | polyester | 1 | 0.0104 | 0.354 | 0.001 | 0.961 | 0.037 |
| 2 | polyester | 1 | 0.0112 | 0.458 | 0.001 | 0.971 | 0.028 |
| 3 | foil | 1 | 0.0142 | | 0.948 | 0 | 0.052 |

TABLE 7-continued

| Sample Number | Substrate | No. of Coating Layers | Active Coating Thickness (cm) | l/d ($cm^{-1}$) | Reflection | Transmission | Absorption |
|---|---|---|---|---|---|---|---|
| 4 | foil | 1 | 0.0150 | | 0.924 | 0 | 0.076 |
| 5 | foil | 2 | 0.0229 | | 0.884 | 0 | 0.116 |
| 6 | foil | 2 | 0.0211 | | 0.877 | 0 | 0.123 |

FIG. 26 is a tricoordinate graph of these susceptors. Numbers on the graph correspond to the sample numbers in Table 7. Because the foil is a reflector there is no transmission for the lossy layer on the foil substrate. Lossy layers on foil increase in absorption as thickness increases. The absorption level nearly doubles over this range of thicknesses. Changes of this magnitude can have a significant effect on cooking as seen in Example VI. Similar coatings on polyester are highly transmissive.

FIG. 27 illustrates the surface temperature profile, by infrared thermography, of sample 5 from Table 7 and the surrounding oven floor as it was heated 1 minute at constant full power (725 Watts) in a variable power Gerling Laboratories Model GL 701 microwave oven. The susceptor is shown as AR1 and the surrounding oven floor is shown as AR2 on FIG. 27. The susceptor, heating primarily due to magnetic field since the tangential electric field at the foil substrate will be zero, absorbed microwave energy and reached a mean temperature of 49.6° C. The oven floor warmed to 37.1° C. because it is made of a slightly lossy material.

EXAMPLE V

Example V is provided to illustrate that susceptors made in accordance with the present invention do not significantly change in operating characteristics because of exposure to microwave radiation. It also shows that the type of substrate is not critical to maintain operating characteristics.

In this example active coatings made with different ratios of graphite and ferrite (Titan FCX-1276) to an acrylic binder were applied with a silk screen process to a variety of substrates. Some of the sample were then heated in a Litton Generation II microwave oven with a product load of 8 refrigerated dough biscuits (Pillsbury Buttermilk, total net weight 176 g.) for 2 minutes 20 seconds at full power. A 48 gauge polyester sheet was placed between the biscuits and the susceptor to prevent sticking. The sample identifications, formulas and coating thicknesses are given in Table 8.

TABLE 8

| Ident. Code/ Sample Number | Graphite % by weight, wet basis | Ferrite % by weight, wet basis | Acrylic % by weight, wet basis | Water % by weight, wet basis | Substrate | Active Coating Thickness (cm) |
|---|---|---|---|---|---|---|
| 114A/1 | 3.809 | 34.286 | 57.143 | 4.762 | polyester film | 0.0114 |
| 114A/2 | 3.809 | 34.286 | 57.143 | 4.762 | polyester film | 0.0104 |
| 114A/3 | 3.809 | 34.286 | 57.143 | 4.762 | baker's parchment | 0.0107 |
| 114A/4 | 3.809 | 34.286 | 57.143 | 4.762 | baker's parchment | 0.0091 |
| 114A/5 | 3.809 | 34.286 | 57.143 | 4.762 | polyester on paperboard | 0.0099 |
| 114A/6 | 3.809 | 34.286 | 57.143 | 4.762 | polyester on paperboard | 0.0081 |
| 114A/7 | 3.809 | 34.286 | 57.143 | 4.762 | polyester-etherimide | 0.0099 |
| 114B/1 | 4.762 | 42.857 | 47.619 | 4.762 | polyester film | 0.0112 |
| 114B/2 | 4.762 | 42.857 | 47.619 | 4.762 | polyester film | 0.0109 |
| 114B/3 | 4.762 | 42.857 | 47.619 | 4.762 | baker's parchment | 0.0114 |
| 114B/4 | 4.762 | 42.857 | 47.619 | 4.762 | baker's parchment | 0.0102 |
| 114B/5 | 4.762 | 42.857 | 47.619 | 4.762 | polyester on paperboard | 0.0109 |
| 114B/6 | 4.762 | 42.857 | 47.619 | 4.762 | polyester on paperboard | 0.0091 |
| 114B/7 | 4.762 | 42.857 | 47.619 | 4.762 | polyester-etherimide | 0.0086 |
| 114C/1 | 5.714 | 51.429 | 38.095 | 4.762 | polyester film | 0.0112 |
| 114C/2 | 5.714 | 51.429 | 38.095 | 4.762 | polyester film | 0.0119 |
| 114C/3 | 5.714 | 51.429 | 38.095 | 4.762 | baker's parchment | 0.0119 |
| 114C/4 | 5.714 | 51.429 | 38.095 | 4.762 | baker's parchment | 0.0117 |
| 114C/5 | 5.714 | 51.429 | 38.095 | 4.762 | polyester on paperboard | 0.0094 |
| 114C/6 | 5.714 | 51.429 | 38.095 | 4.762 | polyester on paperboard | 0.0122 |

TABLE 8-continued

| Ident. Code/ Sample Number | Graphite % by weight, wet basis | Ferrite % by weight, wet basis | Acrylic % by weight, wet basis | Water % by weight, wet basis | Substrate | Active Coating Thickness (cm) |
|---|---|---|---|---|---|---|
| 114C/7 | 5.714 | 51.429 | 38.095 | 4.762 | polyester-etherimide | 0.0109 |

The susceptors were characterized before and after heating the biscuits in the microwave oven by measuring reflection, transmission and absorption with a network analyzer with a WR340 waveguide (impedance of 534 ohms) at 2450 MHz. Mean values for the reflection, transmission and absorption of samples 1, 3, 5, 7 are given in Table 9.

TABLE 9

| | UNUSED | | | USED | | |
|---|---|---|---|---|---|---|
| Identification | Mean Reflection | Mean Transmission | Mean Absorption | Mean Reflection | Mean Transmission | Mean Absorption |
| 114A | 0.004 | 0.930 | 0.066 | 0.003 | 0.951 | 0.046 |
| 114B | 0.014 | 0.825 | 0.161 | 0.011 | 0.864 | 0.125 |
| 114C | 0.022 | 0.767 | 0.211 | 0.018 | 0.810 | 0.172 |

FIG. 28 is a bar chart showing the mean absorption properties both before and after use. It shows that the susceptors are relatively stable with only small changes in their properties. FIGS. 29, 30 and 31 demonstrate the effect of microwave exposure of several formulae on different substrates (data from Table 8). Similar small changes in power absorption (measured in the waveguide using a network analyzer) are observed on the various substrates at the different levels of absorption achieved. This demonstrates the relative stability of the current invention and the flexibility it provides in the selection of substrates. Penetration depths were also determined for some of the unused and used samples. These values are given in Table 10, with sample numbers corresponding to those given in Table 8.

TABLE 10

| Identification Code | Sample | Condition | l/d ($cm^{-1}$) |
|---|---|---|---|
| 114A | 1 | used | 2.60 |
| 114A | 2 | unused | 1.64 |
| 114A | 5 | used | 1.12 |
| 114A | 6 | unused | 0.97 |
| 114B | 1 | used | 5.29 |
| 114B | 2 | unused | 3.94 |
| 114B | 6 | unused | 3.00 |
| 114C | 1 | used | 6.45 |
| 114C | 2 | unused | 7.14 |
| 114C | 5 | used | 3.64 |
| 114C | 6 | unused | 5.29 |

Table 10 shows that as the ratio of graphite and ferrite to the acrylic binder is increased (with code 114A being the lowest and code 114C being the highest), the inverse power penetration depth increases for each substrate. Table 8 contains the formulae for the samples.

EXAMPLE VI

Example VI is provided to illustrate operability of the present invention with food products.

FIG. 32 shows an embodiment of this invention used to enhance the heating of popcorn in a microwave oven. A susceptor consisting of a lossy layer 2 on a paper substrate 1 is attached to the inside of the front side of a paper bag 14 which has gusseted sides to allow for expansion as the popcorn pops. The bag is placed front side down in a microwave oven with a pad of single faced corrugated paper 15 beneath it. The popcorn/salt/oil 10 is only located in the center section immediately above the susceptor at the beginning of the microwave heating cycle.

The coating in this example was composed of 2.5% graphite, 27.5% ferrite (Titan FCX-1276), 50% acrylic base and 20% water by weight, wet basis. It was applied in two layers, curing after each layer, to a paper substrate using a silk screening process. Table 11 shows the coating thickness, the penetration depth and the reflection, transmission and absorption as measured at 2450 MHz in a WR284 waveguide (impedance of 712 ohms) with a network analyzer.

TABLE 11

| Sample Number | Active Coating Thickness (cm) | d (cm) | l/d ($cm^{-1}$) | Reflection | Transmission | Absorption |
|---|---|---|---|---|---|---|
| 1 | 0.0175 | 2.111 | 0.4737 | 0.008 | 0.947 | 0.045 |
| 2 | 0.0188 | 2.991 | 0.3343 | 0.007 | 0.940 | 0.053 |
| 3 | 0.0191 | 1.919 | 0.5211 | 0.009 | 0.948 | 0.043 |
| 4 | 0.0191 | 2.186 | 0.4575 | 0.009 | 0.942 | 0.049 |
| 5 | 0.0206 | 1.862 | 0.5371 | 0.012 | 0.935 | 0.053 |

Five samples of bags with the printed susceptor and six bags with no susceptor were filled with 67.5 g popcorn, 2.5 g salt and 31.5 g oil each. They were heated for 2 minutes 45 seconds at full power in a consumer microwave oven (Litton Generation II). The bags used with susceptor samples 1 and 2 had no browning; bags used with susceptor samples 3, 4 and 5 exhibited slight browning. Popped volume of the popcorn was determined by gently shaking the popcorn into a transparent graduated cylinder. The unpopped kernels were separated by shaking them out of a container having a lid perforated with holes large enough for the unpopped kernels to pass through but small enough to retain popped corn. The results of these tests are presented in Table 12.

TABLE 12

| INVENTION SUSCEPTOR | | | NO SUSCEPTOR | | |
|---|---|---|---|---|---|
| Sample Number | Popped Volume (cc) | Unpopped Kernels (g) | Sample Number | Popped Volume (cc) | Unpopped Kernels (g) |
| 1 | 1700 | 20.2 | 6 | 1700 | 19.1 |
| 2 | 1800 | 18.2 | 7 | 1425 | 28.7 |
| 3 | 2000 | 12.9 | 8 | 1500 | 25.1 |
| 4 | 2100 | 13.4 | 9 | 1400 | 26.6 |
| 5 | 1975 | 13.2 | 10 | 1275 | 28.6 |
| | | | 11 | 1350 | 27.0 |
| MEAN | 1915 | 15.6 | | 1442 | 25.9 |

This example demonstrates that invention susceptors can be used with a common consumer microwave product, popcorn. The invention susceptors improved popped volume and decreased unpopped kernels without overheating and burning the popcorn bags.

EXAMPLE VII

Example VII is provided to illustrate operability of the present invention with a food product i.e., pizza.

The thin film susceptor (aluminum vacuum deposited on polyester) normally used for crisping and browning a commercial pizza (Totino's Microwave Crisp Crust Pizza) was replaced with an invention susceptor as shown in FIG. 33. The pizza 16 was placed on the susceptor, which consisted of a lossy layer 2 applied to the polyester side of the polyester-coated paperboard substrate 1. This assembly was placed on the inverted pizza carton 19 (composed of polyethylene-coated paperboard) which elevated the susceptor 1¼ inch off the microwave oven floor.

The coating was composed of 22.2% graphite, 66.7% acrylic base and 11.1% water by weight, wet basis. It was applied in a single layer using a silk screen process to the polyester side of the polyester-coated paperboard. After curing the coating was of 0.0045 cm thick with a penetration depth of 0.193 cm. The penetration depth of the lossy layer was also determined after the susceptor was used to heat a pizza. Evaluation of several sections from the same susceptor showed penetration depths of 0.153, 0.153, 0.309 and 0.117 cm (mean of 0.183 cm) after being used to heat the above pizza for 2 minutes 30 seconds at full power in a Litton Generation II microwave oven.

The pizza crust in this example is a precooked frozen product that has very slight browning and a highly irregular bubbled bottom surface. When the pizza is reconstituted by microwave heating without any auxiliary heater, the crust is limp and soggy with no additional browning. A pizza heated on top of a thin film susceptor is crisp with browning. The pizza heated on top of the invention susceptor had attributes equal to those of the pizza heated on the thin film susceptor. The crust was crispy and there was considerable crust browning. This demonstrates that invention susceptors can be successfully used for the microwave heating of frozen pizza.

EXAMPLE VIII

In this example the stability of printed susceptors is compared to the stability of conventional thin metallized film susceptors during microwave heating. The printed coating was formulated to have similar performance characteristics to the initial properties of typical thin film susceptors. The printed coating was composed of 18.2% graphite, 36.4% ferrite (Titan FCX 1510), 25.4% acrylic base and 20% water by weight, wet basis. The coating was applied using a silk screen process to polyester side of the polyester-coated paperboard. Two layers were used, with the second layer applied after the first layer had cured. Average coating thickness (total of both layers) was 0.0232 cm. The properties of the printed and thin film susceptors before use are given in Table 13 below. The reflection transmission and absorption values were determined in a WR284 waveguide (impedance of 712 ohms) using a network analyzer operating at 2450 MHz.

TABLE 13

| Sample Number | Reflection | Transmission | Absorbtion |
|---|---|---|---|
| Thin Film 1 | 0.596 | 0.051 | 0.353 |
| Thin Film 2 | 0.610 | 0.045 | 0.345 |
| Thin Film 3 | 0.552 | 0.044 | 0.404 |

TABLE 13-continued

| Sample Number | Reflection | Transmission | Absorbtion |
|---|---|---|---|
| Printed 1 | 0.576 | 0.050 | 0.374 |
| Printed 2 | 0.563 | 0.052 | 0.385 |
| Printed 3 | 0.576 | 0.063 | 0.361 |

The susceptors were then heated in a Litton Generation II microwave oven with a product load of 8 refrigerated dough biscuits (Pillsbury Buttermilk Biscuits, net weight 176 g.) per susceptor for 2 minutes 20 seconds at full power. The susceptors were placed on a single-faced corrugated paper pad and a 48 gauge polyester sheet was placed between the biscuits and the lossy layer to prevent sticking. The used susceptors were characterized with the network analyzer (WR284 waveguide, impedance of 712 ohms at 2450 MHz) and the results, including reflection, transmission and absorption values, are given in Table 14.

TABLE 14

| Sample Number | Reflection | Transmission | Absorbtion |
|---|---|---|---|
| Thin Film 1 | 0.383 | 0.183 | 0.434 |
| Thin Film 2 | 0.176 | 0.539 | 0.285 |
| Thin Film 3 | 0.340 | 0.253 | 0.407 |
| Printed 1 | 0.667 | 0.027 | 0.306 |
| Printed 2 | 0.643 | 0.036 | 0.321 |
| Printed 3 | 0.651 | 0.032 | 0.317 |

It can be seen that the thin film metallized susceptors generally have their operating characteristics changed unpredictably and considerably with use, with reflection generally decreasing and transmission generally increasing. This is illustrated in FIG. 42, a tricoordinate graph of the reflection, transmission and absorption properties of the susceptors. With use, the thin film metallized susceptors became more transmissive and less reflective as indicated by the arrows. The three samples that had very similar properties before use are very different after use, showing lack of predictability as well as lack of stability. The invention susceptors show improved stability and predictability relative to metallized susceptors.

From the foregoing it can be seen that the present invention provides: a heater which can be easily changed in performance characteristics; exhibits minimal change or break down with use; flexibility in material selections in binder, lossy materials, and substrates; selectable performance characteristics of the lossy substance; and the ability to adjust temperature profile laterally across the susceptor.

Figure 34:
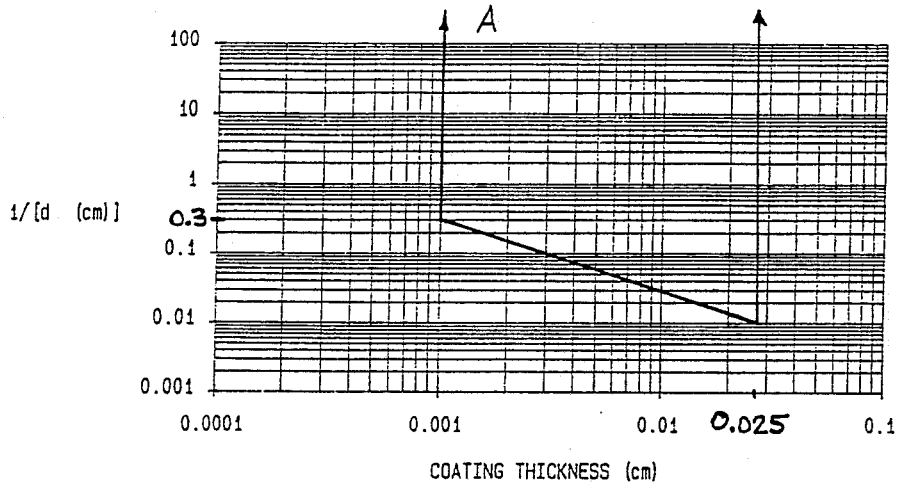

What is claimed is:

1. A microwave heater for use for heating or cooking food in a microwave oven, said heater comprising:

(a) a thermally stable substrate having a first surface; and (b) a lossy layer on at least a portion of said substrate first surface, said loosy layer having at least one region thereof with thickness and inverse power penetration depth which have values within the ranges of about the values within Area A of FIG. 34.

Figure 35:
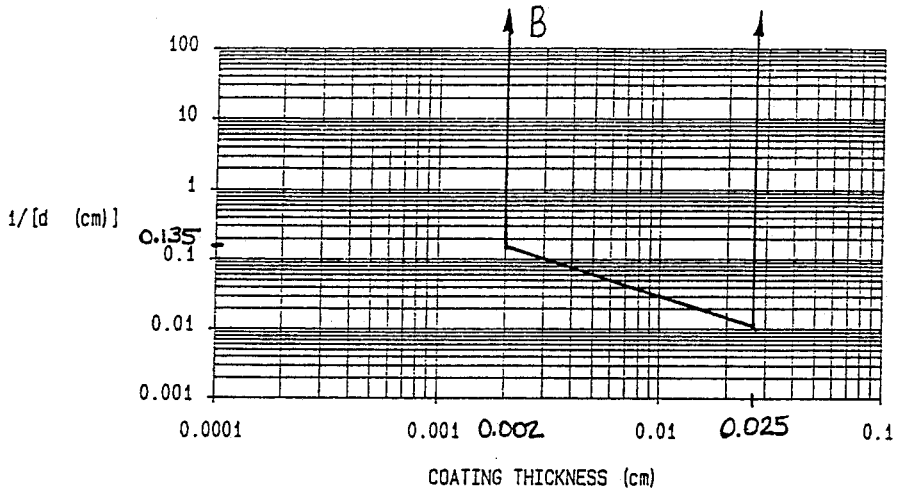
Figure 35:
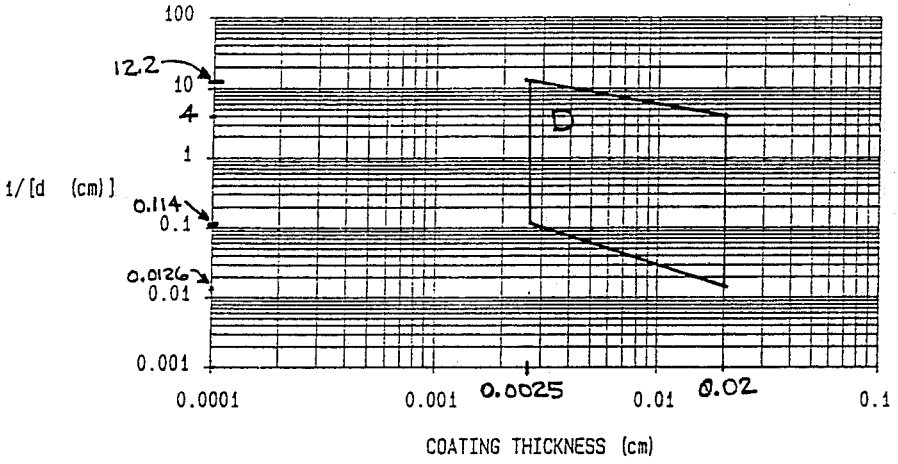

2. A microwave heater as set forth in claim 1 wherein:

(a) said thickness and inverse power penetration depth values are within the ranges of about the values within Area B of FIG. 35.

3. A microwave heater as set forth in claim 1 wherein:

(a) said thickness and inverse power penetration depth values are within the ranges of about the values within Area C of FIG. 36.

4. A microwave heater as set forth in claim 1 wherein:

(a) said thickness and inverse power penetration depth values are within the ranges of about the values within Area D of FIG. 37.

5. A microwave heater as set forth in claim 1, 2, 3 or 4 wherein:

(a) said lossy layer has at least one preselected nonuniformity in at least one characteristic thereof in a preselected pattern across a major surface of said lossy layer.

6. A microwave heater as set forth in claim 5 wherein:

(a) said nonuniformity includes a plurality of different sized regions of lossy layer portions having electrical disruptions between said regions thereof.

7. A microwave heater as set forth in claim 6 wherein:

(a) said different sized regions are positioned in preselected locations across said lossy layer major surface.

8. A microwave heater as set forth in claim 6 wherein:

(a) at least a portion of said regions each have major and minor axial dimensions and the major and minor axial dimensions of said portion of said regions is less than about 1.6 cm.

9. A microwave heater as set forth in claim 6 wherein:

(a) at least a portion of said regions each have major and minor axes and the size of the major and minor axes of said portion of said regions is less than about the size wherein a further increase in the size does not result in an appreciable increase in microwave power absorbed.

10. A microwave heater as set forth in claim 5 wherein:

(a) said nonuniformity includes preselected regions having different inverse power penetration depths across said lossy layer major surface.

11. A microwave heater as set forth in claim 10 wherein:

(a) said regions having different inverse power penetration depths are positioned in preselected locations across said lossy layer major surface.

12. A microwave heater as set forth in claim 5 wherein:

(a) said nonuniformity includes preselected regions having different materials therein across the lossy layer major surface.

13. A microwave heater as set forth in claim 12 wherein:

(a) said different materials are positioned in preselected locations across said lossy layer major surface.

14. A microwave heater as set forth in claim 1, 2, 3 or 4 wherein:

(a) said lossy layer has a ratio of its thickness to the wavelength of microwaves in the lossy layer in at least a portion of said lossy layer of less than or equal to about 0.15.

15. A microwave heater as set forth in claim 1 wherein:

(a) said nonuniformity includes preselected regions having different thicknesses across said lossy layer major surface.

16. A microwave heater as set forth in claim 15 wherein:

(a) said regions having different thicknesses are in preselected locations across said lossy layer major surface.

17. A method of making a microwave heater for use for heating or cooking food in a microwave oven, said method comprising:

(a) applying a mixture of microwave absorptive material and vehicle to a first surface of a thermally stable substrate;

(b) curing said mixture to form a lossy layer which is solid; and (c) said lossy layer having at least one region thereof with thickness and inverse power penetration depth which have values within the ranges of about the values within Area A of FIG. 34.

18. A method of making a microwave heater as set forth in claim 17 wherein:

(a) said thickness and inverse power penetration depth values are within the ranges of about the values within Area B of FIG. 35.

19. A method of making a microwave heater as set forth in claim 17 wherein:

(a) said thickness and inverse power penetration depth values are within the ranges of about the values within Area C of FIG. 36.

20. A method of making a microwave heater as set forth in claim 17 wherein:

(a) said thickness and inverse power penetration depth values are within the ranges of about the values within Area D of FIG. 37.

21. A method of making a microwave heater as set forth in claim 17, 18, 19 or 20 wherein:

(a) said lossy layer has at least one preselected nonuniformity in at least one characteristic thereof in a preselected pattern across a major surface of said lossy layer.

22. A method of making a microwave heater as set forth in claim 21 wherein:

(a) said nonuniformity includes a plurality of different sized regions of lossy layer portions having electrical disruptions between said regions thereof.

23. A method of making a microwave heater as set forth in claim 22 wherein:

(a) said different sized regions are positioned in preselected locations across said lossy layer major surface.

24. A method of making a microwave heater as set forth in claim 22 wherein:

(a) at least a portion of said regions each have major and minor axial dimensions and the major and minor axial dimensions of said portion of said regions is less than about 1.6 cm.

25. A method of making a microwave heater as set forth in claim 22 wherein:

(a) at least a portion of said regions each have major and minor axes and the size of the major and minor axes of said portion of said regions is less than about the size wherein a further increase in the size does not result in an appreciable increase in microwave power absorbed.

26. A method of making a microwave heater as set forth in claim 21 wherein:

(a) said nonuniformity includes preselected regions having different thicknesses across said lossy layer major surface.

27. A method of making a microwave heater as set forth in claim 26 wherein:

(a) said regions having different thicknesses are in preselected locations across said lossy layer major surface.

28. A method of making a microwave heater as set forth in claim 21 wherein:

(a) said nonuniformity includes preselected regions having different inverse power penetration depths across said lossy layer major surface.

29. A method of making a microwave heater as set forth in claim 28 wherein:

(a) said regions having different inverse power penetration depths are positioned in preselected locations across said lossy layer major surface.

30. A method of making a microwave heater as set forth in claim 21 wherein:

(a) said nonuniformity includes preselected regions having different materials therein across the lossy layer major surface.

31. A method of making a microwave heater as set forth in claim 30 wherein:

(a) said different materials are positioned in preselected locations across said lossy layer major surface.

32. A method of making a microwave heater as set forth in claim 17, 18, 19 or 20 wherein:

(a) said lossy layer has a ratio of its thickness to the wavelength of microwaves in the lossy layer in at least a portion of said lossy layer of less than or equal to about 0.15.

33. A method of making a microwave heater for use for heating or cooking food in a microwave oven, said method comprising:

(a) forming a liquid mixture of vehicle and microwave lossy material;

(b) applying said liquid mixture to a surface of a thermally stable substrate to form a layer of said liquid mixture; and (c) curing said liquid mixture to thereby change the liquid into a solid lossy layer with said lossy layer having at least one region thereof with thickness and inverse power penetration depth which have values within the ranges of about the values within Area A of FIG. 34.

34. A method of making a microwave heater as set forth in claim 33 wherein:

(a) said thickness and inverse power penetration depth values are within the ranges of about the values within Area B of FIG. 35.

35. A method of making a microwave heater as set forth in claim 33 wherein:

(a) said thickness and inverse power penetration depth values are within the ranges of about the values within Area C of FIG. 36.

36. A method of making a microwave heater as set forth in claim 33 wherein:

(a) said thickness and inverse power penetration depth values are within the ranges of about the values within Area D of FIG. 37.

37. A method of making a microwave heater setforth in claim 33 wherein:

(a) a said vehicle including a solvent which at least partially evaporates from the liquid mixture during curing thereof.

38. A method of making a microwave heater as set forth in claim 33 wherein:

(a) said vehicle includes a binder material which cures by co-reacting.

39. A method of making a microwave heater as set forth in claim 33 wherein:

(a) said liquid mixture is applied to said substrate by a printing technique.

40. A method of making a microwave heater as set forth in claim 33 wherein:

(a) said liquid mixture is applied to said substrate by a silk screen process.

41. A method of making a microwave heater as set forth in claim 33 wherein:

(a) said liquid mixture is applied to said substrate by a spraying process.

42. A method of making a microwave heater as set forth in claim 33 wherein:

(a) said liquid mixture is applied to said substrate by a coating process.

* * * * *